US011905695B2

(12) United States Patent
Ulliman et al.

(10) Patent No.: US 11,905,695 B2
(45) Date of Patent: Feb. 20, 2024

(54) WASTE COLLECTION AND DISPOSAL SYSTEM FOR TOILETS

(71) Applicant: ZOELLER PUMP COMPANY, LLC, Louisville, KY (US)

(72) Inventors: Andrew Ulliman, Louisville, KY (US); Jerry Banta, Louisville, KY (US); David R. Gilbert, Charlestown, IN (US); Jason Nett, Floyds Knobs, IN (US); Jason Pyle, Crestwood, KY (US)

(73) Assignee: Zoeller Pump Company, LLC, Louisville, KY (US)

( * ) Notice: Subject to any disclaimer, the term of this patent is extended or adjusted under 35 U.S.C. 154(b) by 61 days.

(21) Appl. No.: 17/699,585

(22) Filed: Mar. 21, 2022

(65) Prior Publication Data

US 2022/0298768 A1 Sep. 22, 2022

Related U.S. Application Data

(60) Provisional application No. 63/163,168, filed on Mar. 19, 2021.

(51) Int. Cl.

| | |
|---|---|
| ***E03D 1/26*** | (2006.01) |
| ***E03D 9/10*** | (2006.01) |
| ***E03D 1/02*** | (2006.01) |
| ***E03D 11/17*** | (2006.01) |
| ***E03D 1/00*** | (2006.01) |
| ***E03D 5/01*** | (2006.01) |

(52) U.S. Cl.

CPC ..... *E03D 1/26* (2013.01); *E03D 1/003* (2013.01); *E03D 1/025* (2013.01); *E03D 5/01* (2013.01); *E03D 9/10* (2013.01); *E03D 11/17* (2013.01)

(58) Field of Classification Search

CPC ..... E03D 1/26; E03D 1/003; E03D 1/025; E03D 5/01; E03D 9/10; E03D 11/17; E03F 5/22

USPC ..... 4/321

See application file for complete search history.

(56) References Cited

U.S. PATENT DOCUMENTS

| | | | |
|---|---|---|---|
| 5,038,418 | A | 8/1991 | Frey |
| 6,430,757 | B1 | 8/2002 | Pohler |
| 7,203,976 | B1 | 4/2007 | Weller et al. |
| 8,235,316 | B1 | 8/2012 | Heinsler et al. |
| 8,760,302 | B1 | 6/2014 | MacDonald |
| 8,769,730 | B2 | 7/2014 | Pohler et al. |
| 9,004,381 | B2 | 4/2015 | Schmidt et al. |
| 9,079,187 | B2 | 7/2015 | Ballestra |
| 9,352,327 | B2 | 5/2016 | Schmidt et al. |
| 9,481,991 | B2 | 11/2016 | Pohler et al. |
| 2021/0148365 | A1 | 5/2021 | Ulliman et al. |

OTHER PUBLICATIONS

U.S. Appl. No. 29/737,297, unpublished.

*Primary Examiner* — Christine J Skubinna

(74) *Attorney, Agent, or Firm* — Scott R. Cox; Jessica C. Ronald; Jeffery Langer

(57) ABSTRACT

A waste collection and disposal unit including a tank, a float-switch sensing system, and a grinder pump. The tank contains a contoured and sloping floor, a front section, a back section, two side sections and a one-piece lid, which is securable onto the other sections of the tank. The floor slopes downwardly from below the float-switch sensing system to below the grinder pump at an angle of at least about 5 degrees and is contoured in a downward curved arc between the front and back sections of the tank.

20 Claims, 24 Drawing Sheets

WASTE COLLECTION AND DISPOSAL SYSTEM FOR TOILETS

CROSS REFERENCE TO RELATED APPLICATION

This Application claims priority from provisional application Ser. No. 63/163,168, filed Mar. 19, 2021.

BACKGROUND OF INVENTION

The present invention relates to a self-contained, fluid and waste collection and disposal system for toilets.

This section is intended to introduce various aspects of art that may be related to the present inventions, which are described below. This discussion is believed to be helpful in providing background information to facilitate a better understanding of the various aspects of the present inventions. Accordingly, these statements are to be read in that light but not as admissions of prior art.

Floor level waste collection and disposal units for toilets have utility for bathrooms in locations not easily modified for use with below floor level piping commonly utilized with bathroom fixtures. For example, such units are particularly useful when a bathroom is added to an existing basement or onto an existing concrete slab. Because of the difficulty in construction as well as the expense associated with installation of below floor level bathroom piping in these circumstances, these self-contained, floor level bathroom facilities, along with the piping utilized therewith, are necessarily located above the level of the floor or concrete slab.

Some self-contained, floor level bathroom waste collection and disposal units for toilets include a conventional toilet, secured on top of a floor level tank for receipt of waste from the toilet. While such self-contained, floor level toilet facilities can be useful, certain inherent disadvantages exist because of the requirement that the toilet is located above floor level on top of the waste collection tank.

In contrast, one example of a waste collection and disposal system, which is located behind a toilet, is the QWIK JON® ULTIMA Model 202 toilet grinder system, which is designed and sold by Zoeller Pump Company, LLC, Louisville, Ky. This system is a free standing or built-in installation designed to accommodate toilets, a lavatory, sinks and/or a shower, which utilizes a horsepower grinder pump.

Other waste collection and disposal systems, which are located behind the toilet, are known in the art. Some of these systems utilize a specially designed toilet basin containing a rear discharge outlet located in a position that is significantly higher than is utilized by conventional rear discharge toilets. This added height of the discharge outlet increases the volume of waste that can be received in the waste collection tank during each flushing cycle. The pump for such a system which is used to discharge the waste from the waste collection tank is a conventional macerating pump, which pumps the waste out through discharge piping without further processing of the waste. Given the significant number of different components in this system and the placement of these components, it is often difficult and time consuming to make repairs to this system. Further, it can be a challenge for a service person to access one component of this system without moving other components during servicing.

Therefore, a need exists for an improved floor level bathroom waste collection and disposal tank which operates efficiently with a rear outlet toilet. There is a further need for a specially designed floor level waste discharge tank, which encourages the flow of bathroom waste from an inlet opening in the tank to a grinding and pumping system for grinding the bathroom waste prior to discharge to an external facility.

There is also a need for a floor level, waste discharge tank for receiving waste from a rear outlet toilet which is both lightweight and mechanically strong, yet contains handling features permitting easy transportation, installation, and repair.

There is also a need for a floor level, waste discharge system which has high efficiency for processing waste, containing a grinder system with cutter and cutter blades which efficiently macerates waste contained therein.

There is also a need for a floor level, waste discharge tank that contains a pump motor and float switch system that are secured at convenient locations within the tank of the system and which are easily accessible for servicing. To make such system accessible for servicing, the components of the system should be modularized for easy access, removal, and servicing.

The objects and features of the present invention discussed throughout the application become apparent to those skilled in the art from a consideration of the following detailed description, drawings, and claims. The description, along with the accompanying drawings, provides a selected example of construction of the device to illustrate embodiments consistent with the inventive concepts described herein, but does not place a limitation on the scope of the claims.

SUMMARY OF THE INVENTION

The present invention discloses a modularized waste collection and disposal unit, particularly for toilets, including a tank which contains a float-switch sensing system, that senses the level of waste or fluids within the tank, and a grinder pump. The tank, in one embodiment is a molded tank that contains a contoured and sloping floor, a front section, a back section, two side sections, and in one embodiment a one-piece lid.

In one embodiment the surface of the floor slopes downwardly from an area below the float-switch sensing system to an area below the grinder pump at an angle of at least about 5 degrees. In addition to sloping, the surface of the floor is contoured in a downwardly facing curved arc extending between the front and back sections of the tank.

In one embodiment a float-switch sensing system utilized with the waste collection and disposal unit is a modularized component unit and includes a float housing, which includes a float with float stoppers, and a switch housing containing electronic components, which components activate the grinder pump. The switch housing and the float housing are connected, molded, or secured together. A lower edge of the float housing is open and, in one embodiment, is angled at an angle that is like the angle of the slope of the surface of the floor of the tank. Further, in one embodiment, this edge is also contoured to mirror the contouring of the floor.

DETAILED DESCRIPTION OF A PREFERRED EMBODIMENT

Figure 1:
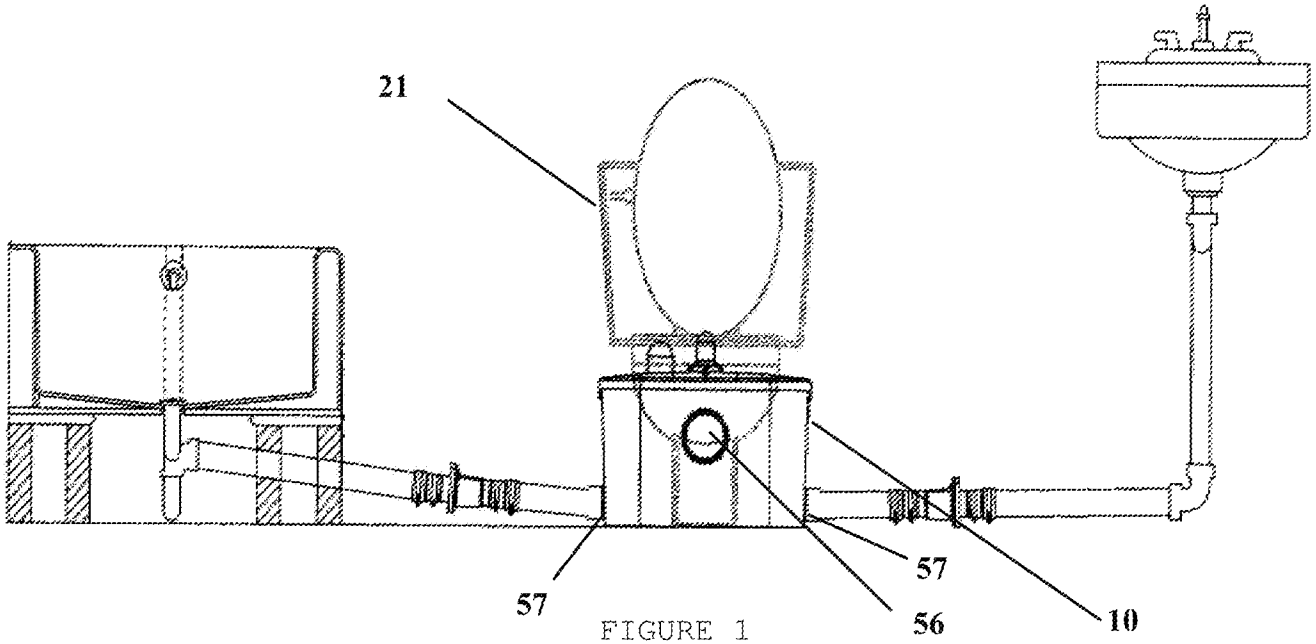
FIG. 1 is a side view of a waste collection and disposal unit installed with a toilet, bathtub, and sink fixtures.
Figure 2:
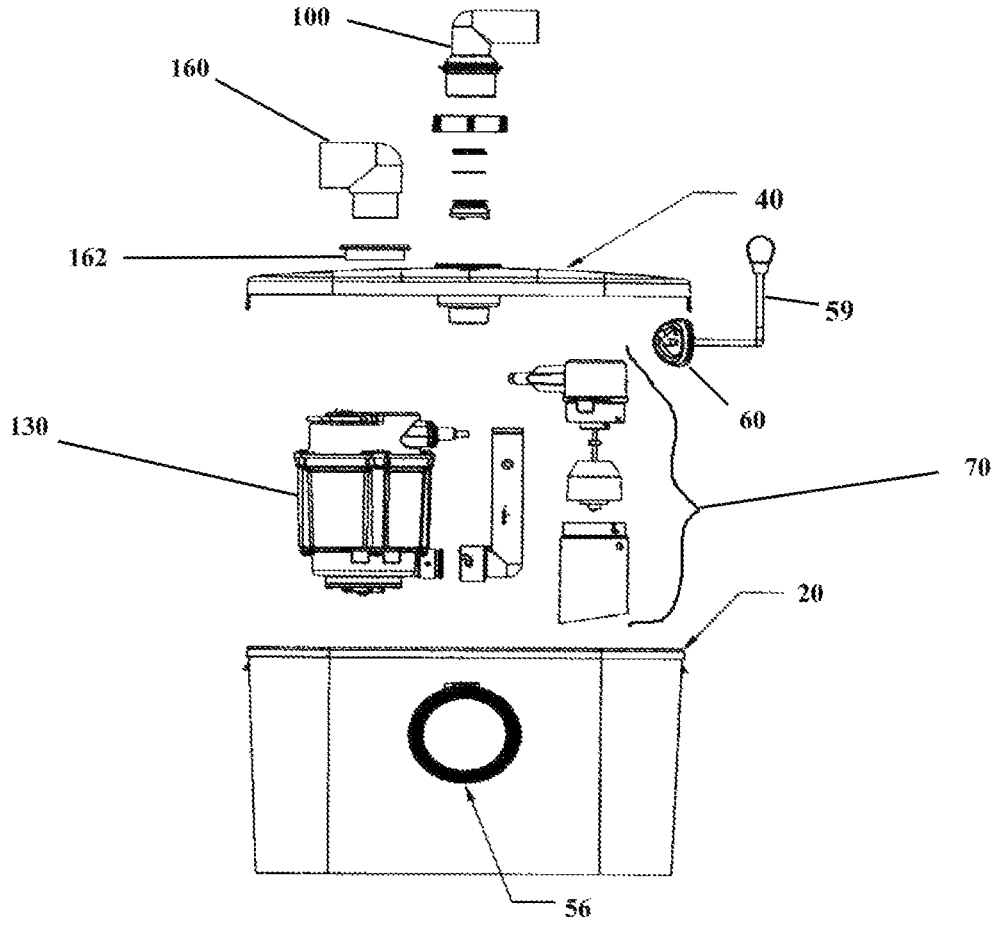
FIG. 2 is a side exploded view of the unit of FIG. 1.

Referring to FIG. 1, there is shown a modularized, waste collection and disposal unit 10 that is utilized with toilets. Typically, such a waste collection and disposal unit is located at floor level and is placed within a basement or other location where a conventional toilet system, which relies on gravity to provide drainage and contains below floor level piping, cannot easily be installed.

The waste collection and disposal unit 10 is conventionally attached to a rear outlet toilet 21 and is placed on the floor of a bathroom. Other sources of waste that are commonly generated within bathrooms, such as from a bathtub or sink, can also be attached to the unit, as shown in FIG. 1. Typically, the waste from these sources flow into the waste collection and disposal unit for treatment and are then discharged through appropriate discharge elements.

The waste collection and disposal unit 10 includes a modularized tank 20, within which is secured a modularized float-switch sensing system 70 and a pump 130 as shown, for example, in FIGS. 2, 3, 4*a* and 4*b*. By all components of the unit being modularized, installation of the unit and repair of the components thereof is significantly easier then with prior art units. In one embodiment, pump 130 is a grinder pump. In the same or another embodiment, pump 130 is a fractional horsepower pump, such as a horsepower pump.

Figure 5A:
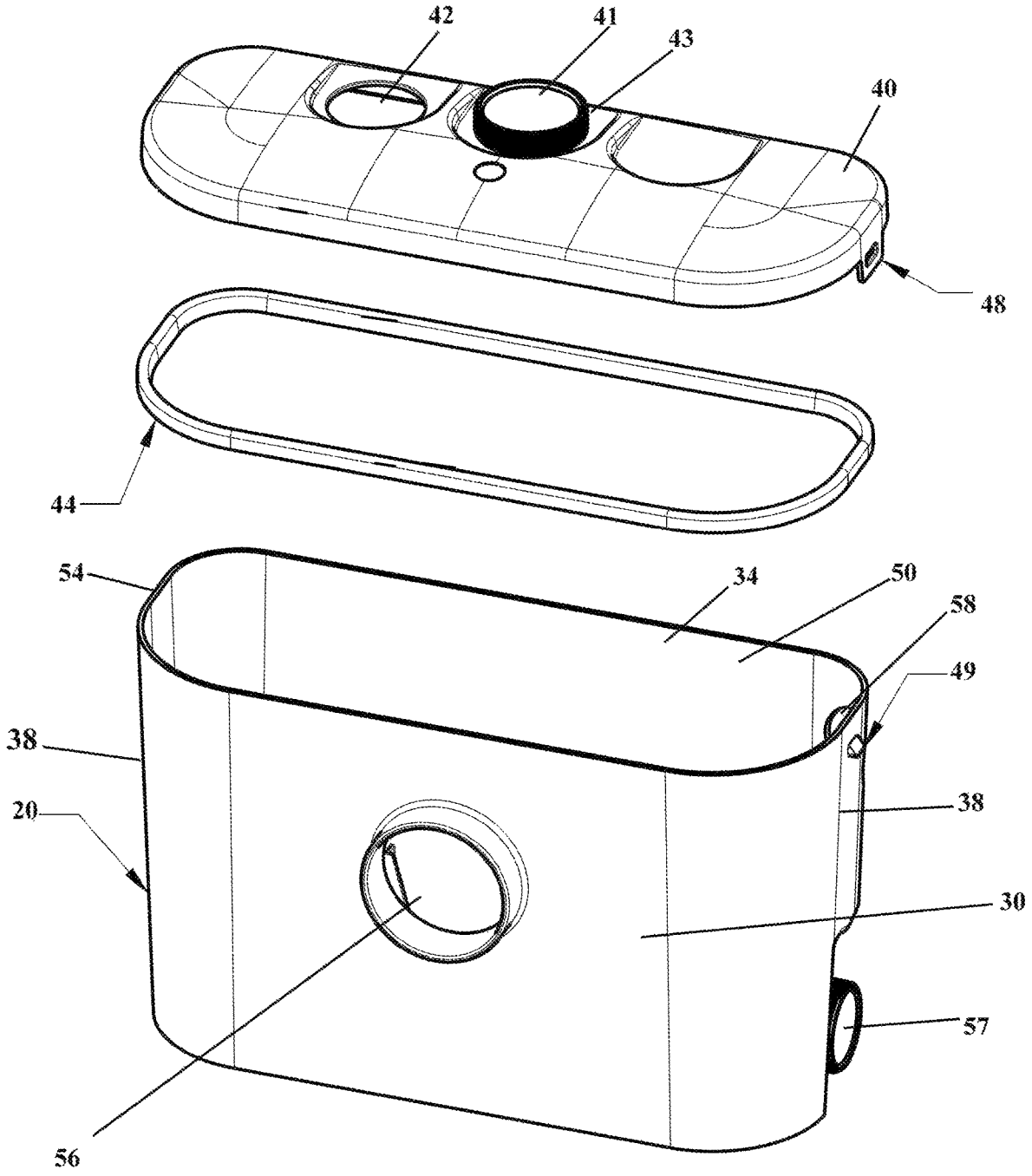
FIG. 5*a* is an exploded view of a tank of the unit of FIG. 1.

The tank 20, as shown in FIGS. 5*a*, 5*b*, 6*a* and 6*b*, includes a front and back section (30, 34), two side sections 38, a floor 22 and a lid 40. The tank, in one embodiment, is molded with support structures 28 designed to support the tank when placed in position for use. The lid 40, in one embodiment, is a one-piece lid, as shown in FIG. 5*a*.

Figure 3:
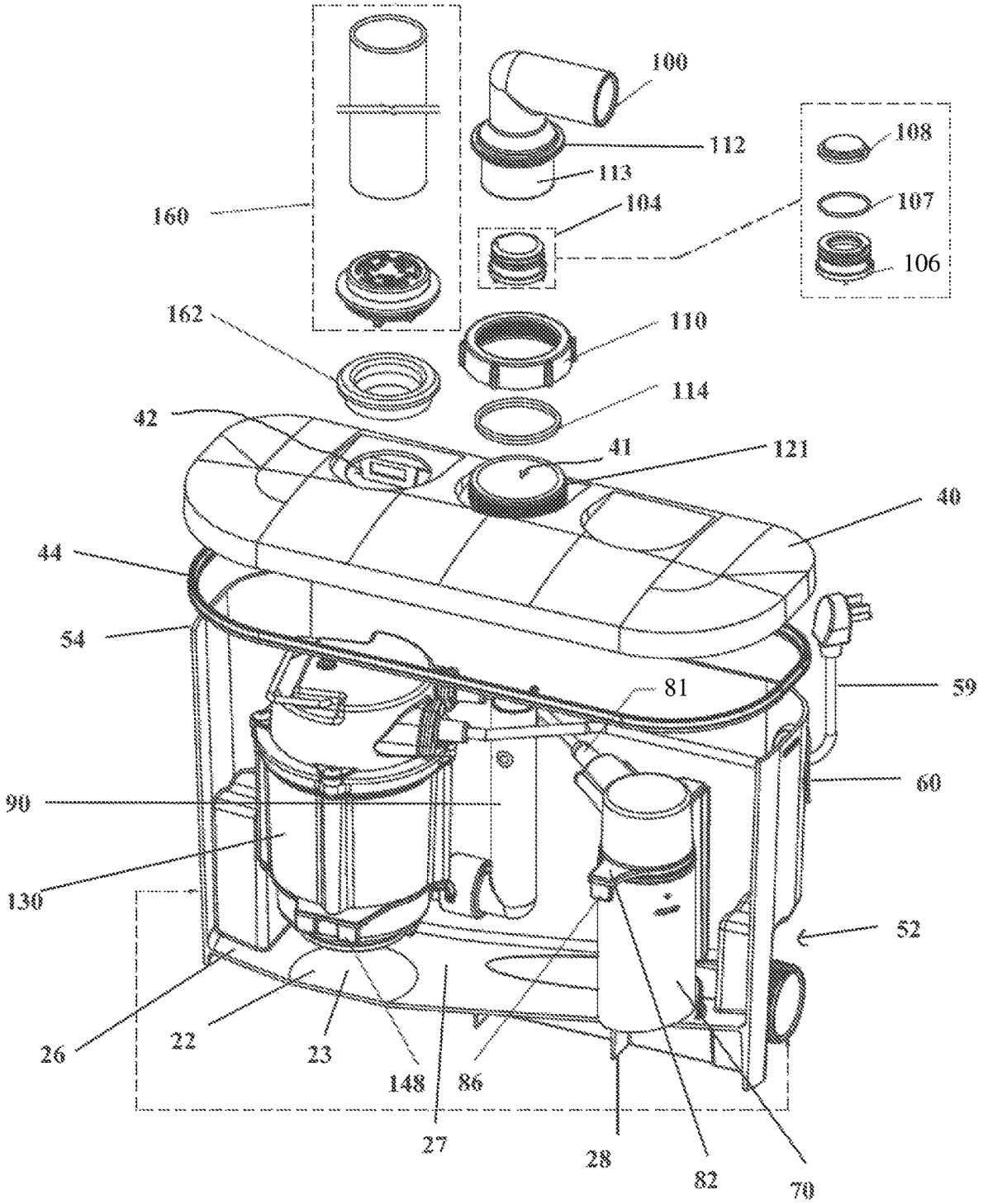
FIG. 3 is a perspective, cutaway, partially exploded view of the unit of FIG. 1.
Figure 6A:
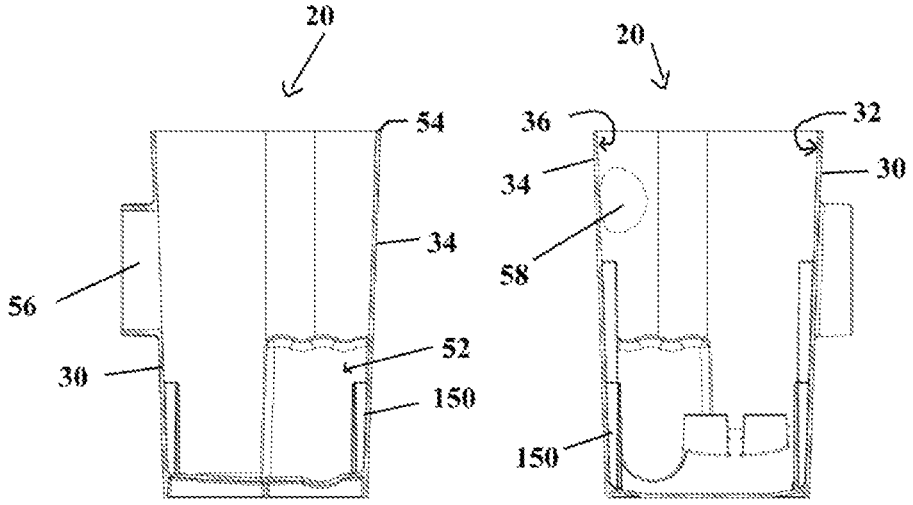
FIG. 6*a* are two partial cutaway views of opposite ends of the tank of FIG. 5*a*.

Inwardly indented openings 52 are provided in each side of the tank 20, as shown in FIGS. 3 and 6*a*, which form hand-shaped openings useful for lifting of the tank. An upper surface of each indented opening in one embodiment is corrugated to provide better holding capability when the tank is lifted. The design of these indented openings and the upper surface thereof can be varied for optimization.

Figure 4A:
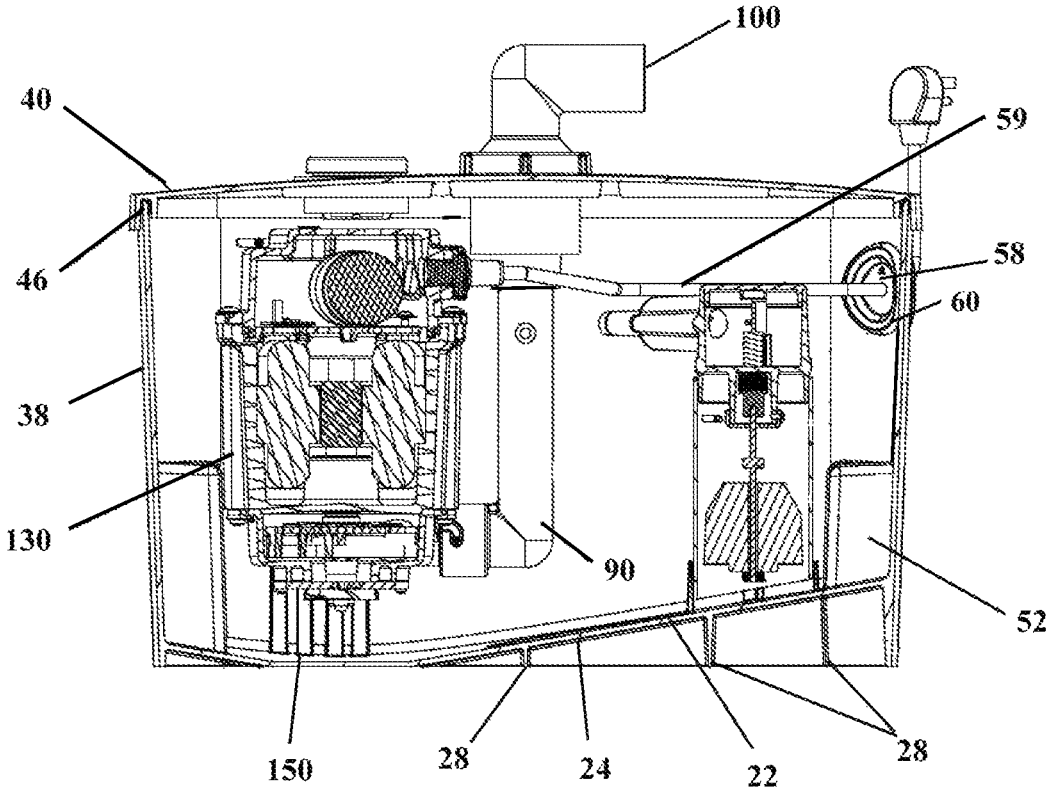
FIG. 4*a* is a side cutaway view of the unit of FIG. 1.

A side opening 58 in one embodiment is provided in at least one side section of the tank 20 into which a seal 60 with slot therein is secured, as shown in FIG. 4*a*. This opening is provided, in one embodiment, in a rounded corner of the side section 38 of the tank where the back section 34 meets the side section of the tank. The slot in the seal is designed to fit around an electrical cord 59, which extends from the grinder pump to an outlet. The opening is configured to receive a cord seal, the cord seal encompassing a portion of an electrical cord running through the cord seal, wherein the cord seal diameter and the opening diameter are approximately equal. This design for the tank and location of the electrical cord is useful for an installer of the unit 10 because the tank is easily accessible for repairs. The composition of the tank utilizes conventional materials used for bathroom fixtures, such as PVC or ABS materials.

Waste and fluids from various sources flow into inlets of the tank 20. Combined waste and fluid may also be characterized as effluent. Effluent may be comprised solely of fluid, solely of solid waste, or a combination of the two in different proportions. In one embodiment, as shown in FIGS. 1 and 5*a*, there is a front inlet 56 from a toilet 21 and side inlets 57 from a shower or sink.

Figure 6B:
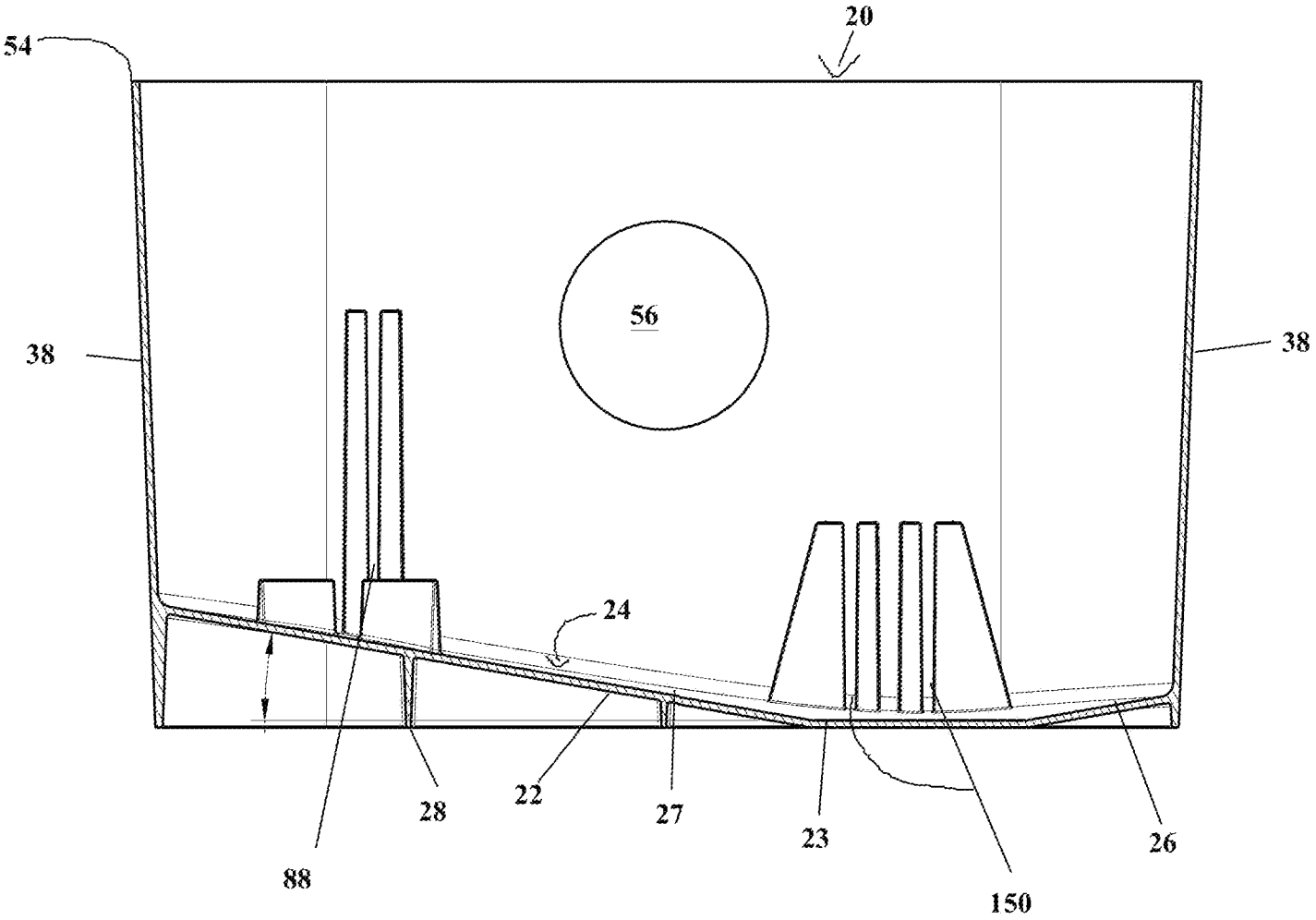
FIG. 6*b* is a front cutaway view of the tank of FIG. 5*a*.

The efficient grinding and evacuation of the waste or fluid is enhanced by the design of the tank, particularly its floor 22, as shown in FIGS. 6*a*, 6*b*, 9*b* and 10*b*. In one embodiment, the floor 22 is formed in a dish-shape. The dish-shape of floor 22 is formed using a flat portion 23 that is joined to sloped portions 25, 26, and 27. In one embodiment, sloped portion 25 runs from front section 30 to flat portion 23. Sloped portion 25 may, in addition, run from back section 34 to flat portion 23, as shown in FIG. 6*b*. Likewise, sloped portions 26 and 27 may run from side sections 38 to flat portion 23. See FIGS. 6*a* and 9*b*. In one embodiment, flat portion 23 is formed below a cutter plate 142. By forming flat portion 23 below the cutter plate 142, waste and water entering the system is directed to the grinder pump 130. In particular, the gravitational pull on waste and water on the sloped portions 25, 26 and 27 directs the waste and water to the flat portion 23. When flat portion 23 is formed below cutter plate 142, this enhances the efficient treatment of waste and water from the system because the waste and water is easily fed into the grinder pump 130. Although flat portion 23, in one embodiment, is formed directly below cutter plate 142, it is apparent to one of ordinary skill in the art that placement of flat portion 23 may be varied without compromising efficiency gains for removal of waste and water.

Figure 9A:
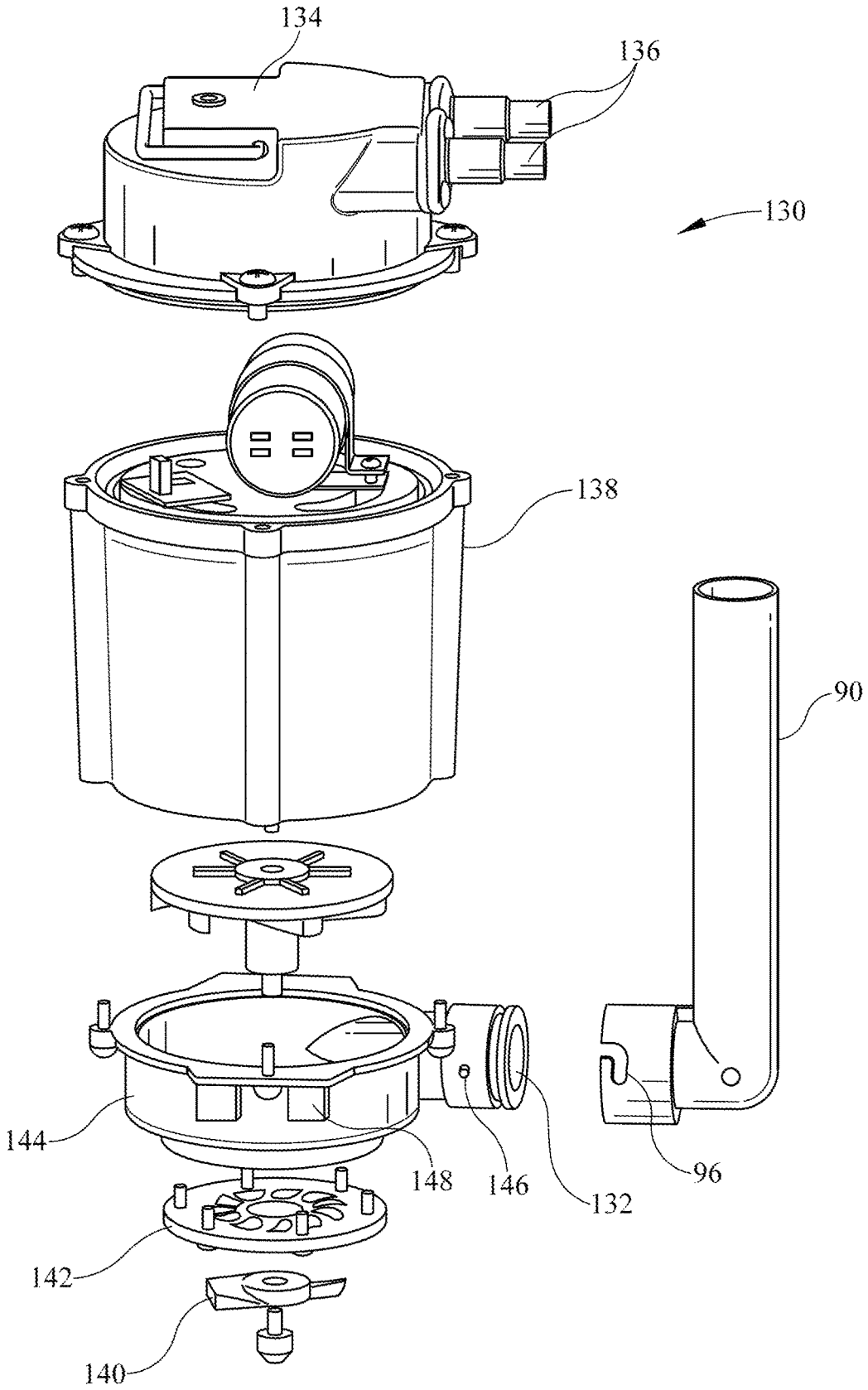
FIG. 9*a* is a perspective exploded view of a grinder pump utilized within the unit of FIG. 1.
Figure 9B:
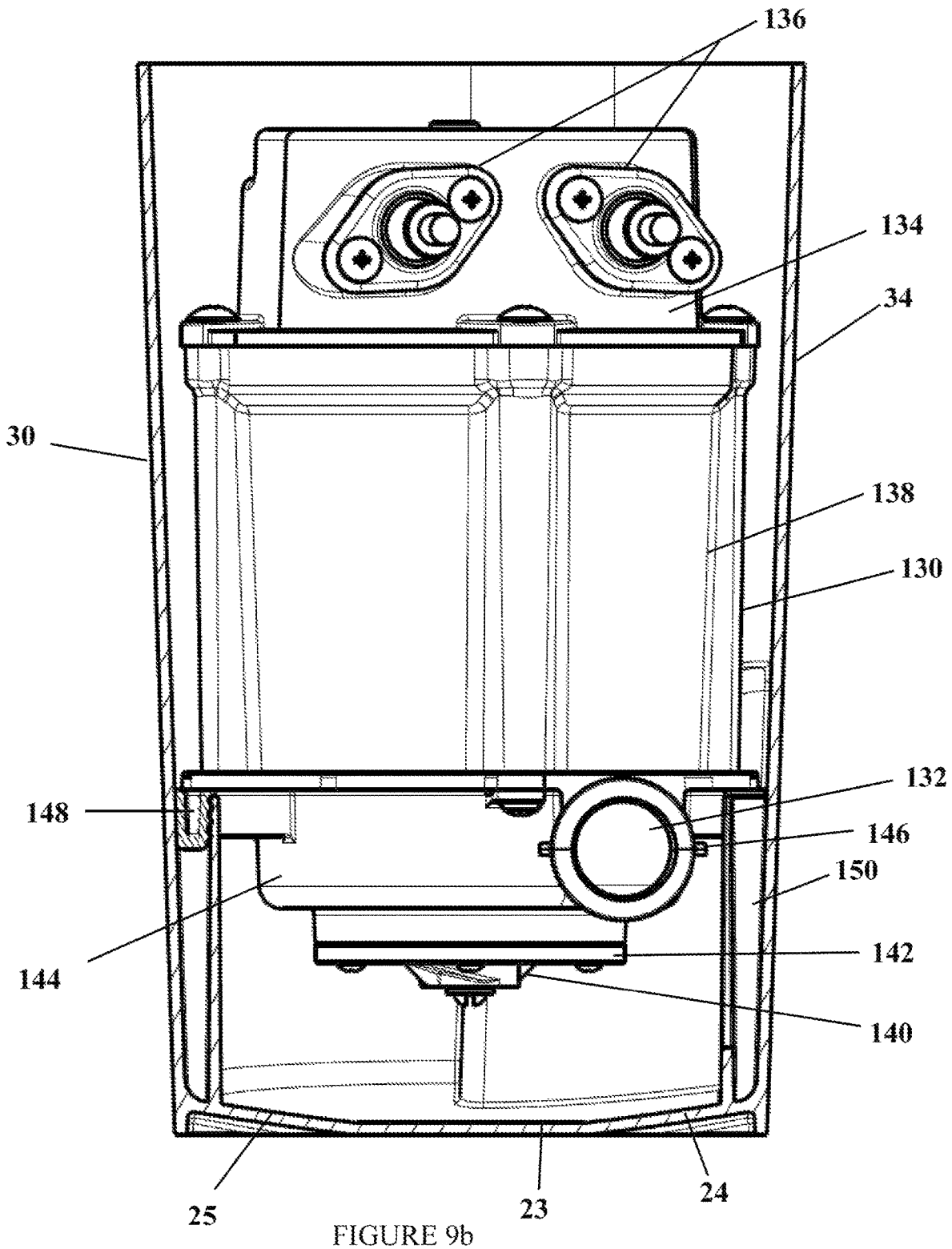
FIG. 9*b* is an end perspective view of the tank of FIG. 5*a* with the grinder pump of FIG. 9*a* installed therein.

To encourage flow of waste and fluid away from the inlets and from the float switch sensing system 70, the floor is contoured and sloped downwardly from below the float switch sensing system to below the grinder pump 130, wherein waste and fluid are processed. The slope of the floor, in one embodiment, is at least about 5 degrees, and, in another embodiment is from about 8 to 12 degrees. In addition to sloping downwardly, the floor 22 is also contoured in a generally downward facing, concave shape from the front section 30 to the back section 34 of the tank, as shown in FIGS. 6*a* and 9*b*. As discussed above, the combination of the downward slope of the floor from below the float-switch sensing system to below the grinder pump and the contoured shape of the floor section from the front section to the back section, results in an efficient flow of waste and fluid to the grinder pump, where they are processed for discharge.

From the above description, it is now apparent to one of ordinary skill in the art that "downwardly" or "downward" as used herein, for example the surface of the floor is contoured in a downwardly curved shape, provides direction relative to other structural elements described herein. Specifically, with regards to downwardly, one of ordinary skill in the art will now understand that downwardly describes a directional vector running from the interior surface of the lid to the top surface of the floor. In other words, in operation, downwardly is in the direction of gravitational pull and follows the direction that water would flow under normal conditions.

In addition, in one embodiment, note in FIGS. 3, 4*a*, 4*b*, 9*b* and 10*b* that the lowest part 23 of the floor 22 within the tank is below the grinder pump 130. The portion 26 of the floor that is located between the side section 38 of the tank closest to the grinder pump 130 is also contoured and sloped downward to encourage flow of waste and fluid to the grinder pump for processing. See FIGS. 4*a*, 4*b*, 6*b* and 9*b*.

Figure 4B:
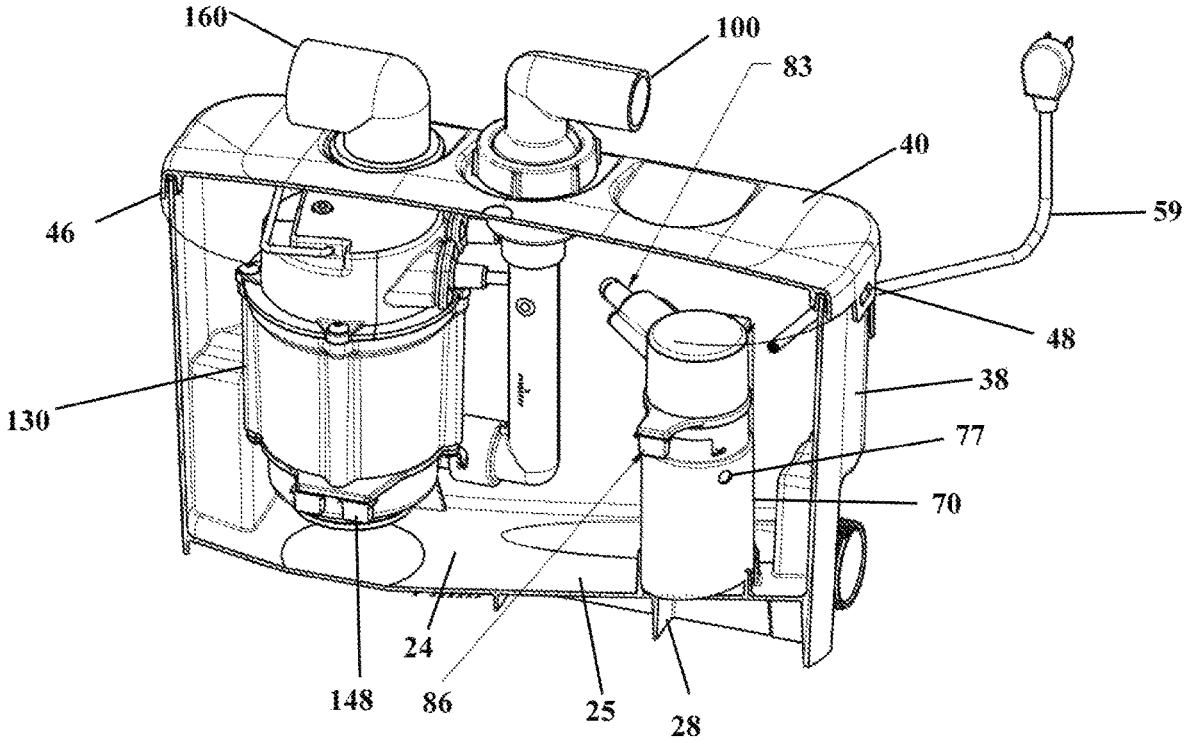
FIG. 4*b* is a perspective cutaway view of the unit of FIG. 1.

Because the surface 24 of the floor of the tank slopes downwardly, support structures 28 supporting the tank 20 are included when the tank is molded and are located below the floor 22, as shown in FIGS. 4*a* and 4*b*. These support structures can be molded in different designs and shapes. In one embodiment, as shown in FIGS. 4*a* and 4*b*, the support structures constitute legs extending downward from the floor.

Figure 8:
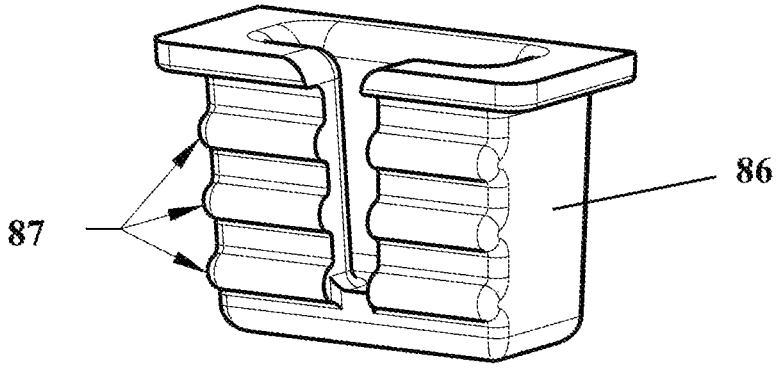
FIG. 8 is a perspective view of a rubberized foot utilized within the unit of FIG. 1.

The grinder pump 130 is secured within the tank above the lowest part of the floor of the tank, as shown in FIGS. 3, 4*a* and 4*b*. In one embodiment, there is secured to a side of the grinder pump rubberized feet 148, as shown in FIGS. 9*a* and 9*b*. In one embodiment, the rubberized feet include alternatively raised structure on a surface thereof to enhance frictional resistance of the feet when inserted into position within the tank, as shown in FIG. 8. It will be apparent to one of ordinary skill in the art that other foot designs may be used to assist in securing the pump and other structures into the tank. For example, although a plurality of ridges 87 are illustrated in FIG. 8, in another embodiment, a single ridge may be used. In another embodiment, ridges may be formed that run parallel to the sections 30, 34 and 38. In another embodiment, raised structures other than ridges may be used. For example, protruding dots may be formed on an outer surface of the rubberized foot 148. Alternatively raised structure includes ridges formed in a pattern having uniform peaks and valleys. The alternatively raised structure may have non-uniform peaks and valleys. Alternatively raised structures may also include protruding nubs extending off a surface plane parallel to the outside surface of the rubberized feet. The nubs may be arranged in a matrix over the plane. Alternatively, the nubs may be arranged in a non-uniform pattern on the plane. One of ordinary skill in the art will now understand that the alternatively raised structure may be any combination of ridge and nubs that secure the feet whether from compressive force against the ridges and nubs, friction created by the surface of the ridges and nubs, or both depending on the specific structural characteristics of the feet as required by engineering, design, and manufacturing requirements.

These feet are introduced into slots 150 molded on the inside surface of the back and front sections (30, 34) of the tank 20, as shown in FIGS. 6*a*, 6*b* and 9*b*. In one embodiment, these slots are secured to or molded into the back and front sections of the tank during production of the tank. By securing the rubber feet of the grinder pump 130 into these slots, stability of the pump within the tank is provided. In addition, this structure for securing the grinder pump within the tank is also useful to reduce the impact of vibration when the grinder pump is running.

Further efficiency of operation of the grinder pump is achieved by inclusion of an updated cutter system. This cutter system includes a cutter plate 142 and a cutter blade 140. See FIG. 9*a*. Because of the efficiency in overall operation of the waste collection and disposal system of this embodiment, a fractional horsepower motor can be used as part of the grinder pump. To enhance further operations of the waste collection and disposal system, the grinder pump is a reversable grinder pump.

To enhance the utility of waste collection and disposal unit 10, the grinder pump 130 is constructed to limit the grinder pumps exposure to fluids present within the tank 20. One embodiment of a grinder pump is shown in FIG. 9*a*, wherein the grinder pump is surrounded by a pump housing 138 and covered by an upper pump housing cover 134. To enhance this structure, electrical cords, which extend from the grinder pump, are sealed in cord seals 136. See FIG. 9*b*. In addition, there is secured to the bottom of the pump housing a lower pump housing cover 144 from which an outlet 132 extends. By this structure of the pump housing and related components, all electrical components of the grinder pump are reasonably well protected against exposure to fluids present in the tank, as required under Industry Standard IP 68.

Figure 5B:
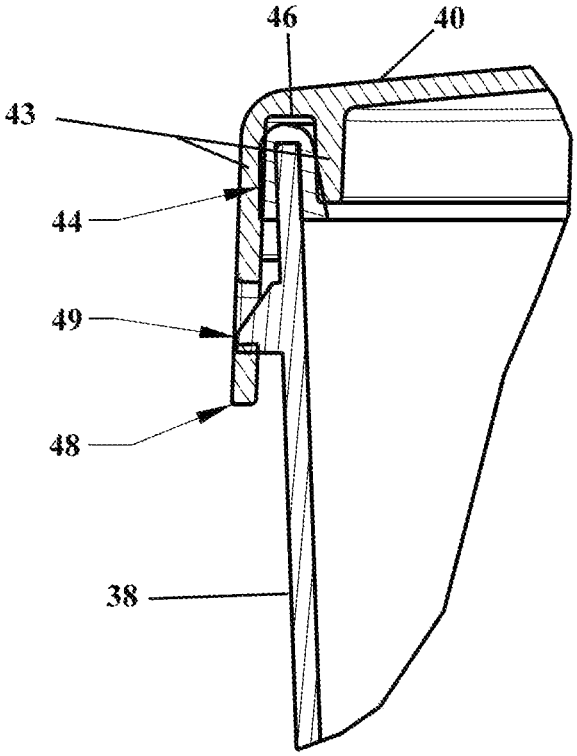
FIG. 5*b* is a cutaway view of an edge of the tank of FIG. 5*a* showing a structure used for joining of a lid to a side of the tank.

The lid 40 of the tank 20, in one embodiment, is a modularized one-piece lid, which is snap-fit onto upper edges 54 of the sides, front and back sections of the tank (30, 34, 38), as shown in FIGS. 4*a*, 4*b*, 5*a* and 5*b*. In one embodiment, the lid is made of the same materials as is the tank. To securely attach the lid to the tank, but permit it to be easily removable, the lid has downwardly extending inner and outer lips 43, as shown in FIG. 5*b*, which form a downwardly facing slot 46 into which the upper edge of each of the side, front, and back sections of the tank fits securely. (See FIGS. 4*a* and 4*b*.) A lip seal 44 surrounds the upper lip of these sections of the tank. When the lid of the tank is attached to the sides of the tank, the lip seal fills the slot forming a secure seal. In one embodiment, on one side of lid 40 and extending downward from the surface of the lips of the lid is a clip with opening 48, as shown in FIGS. 4*b*, 5*a* and 5*b*. When the lid is attached onto the tank, an opening in the clip snaps over clip edge 49, which edge, in one embodiment, is molded into the side of the tank, as shown in FIG. 5*b*. When the lid is positioned on the tank, and the opening of the clip is attached to the clip edge, the lid is securely held in place, forming a watertight seal. This structure meets industry requirements under IP 68. Other methods of securing the lid to the sides of the tank are within the skill of a person skilled in the art.

Figure 7A:
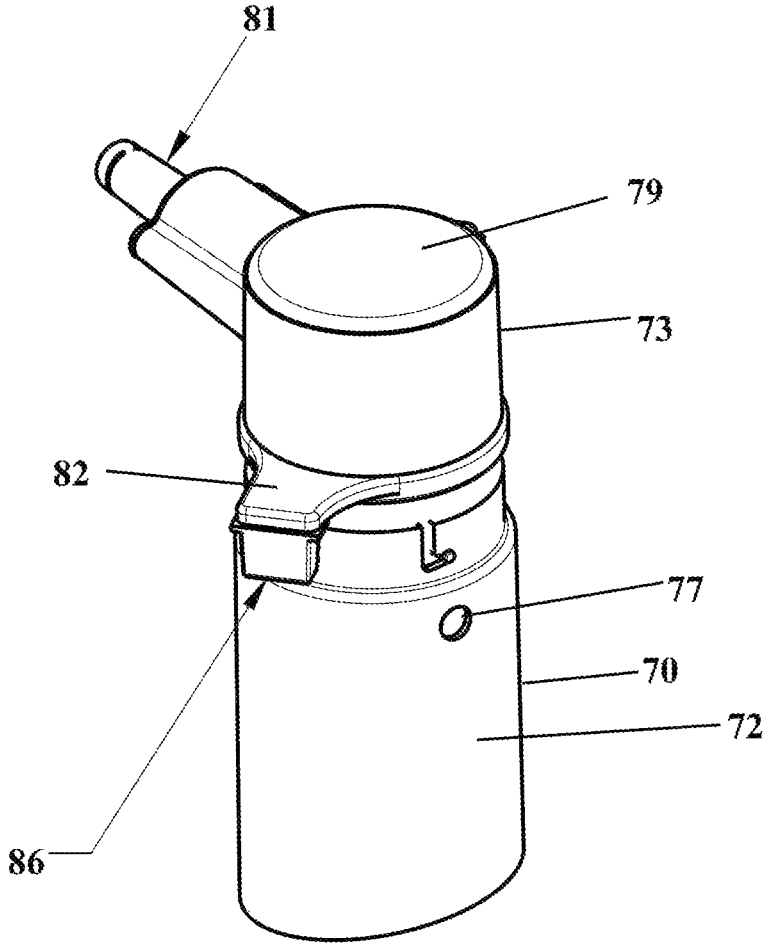
FIG. 7*a* is a perspective view of a float-switch sensing system of the unit of FIG. 1.

The float-switch sensing system 70 is located within one side of the tank 20 away from the inlet 56 from the toilet, as shown in FIGS. 3, 4*a* and 4*b*. This system includes a tubular shaped float housing 72 to which is attached switch housing 73, as shown in FIGS. 7*a* through 7*f*. The switch housing 73, as shown in FIG. 7*d*, includes electronic components of the float system, such as a circuit board 71. To assure a watertight structure for this switch housing, a cap 79 of the float housing is secured to the float housing. Electrical connections from the float housing extend to the grinder pump 130 by a pin connection 83, as shown in FIG. 7*e*. A cord 84 for the wiring from the pump fits into this pin connection. In one embodiment, the electrical wires are surrounded by a switch cord 81, as shown in FIG. 7*a*. In one embodiment, the entire structure is watertight and provides protection for electronic components associated with the float-switch sensing system.

Figure 7B:
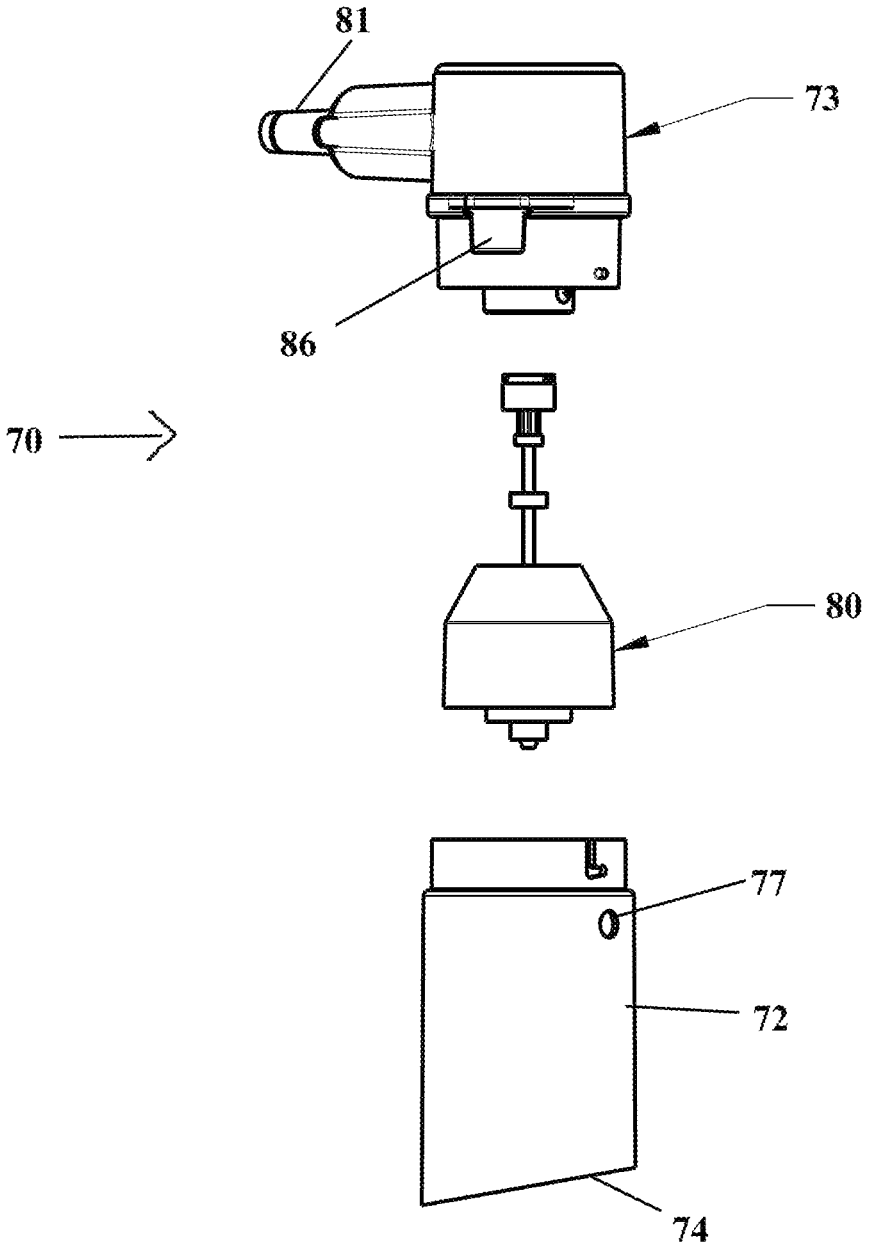
FIG. 7*b* is a partially exploded view of the float-switch sensing system of FIG. 7*a*.
Figure 7C:
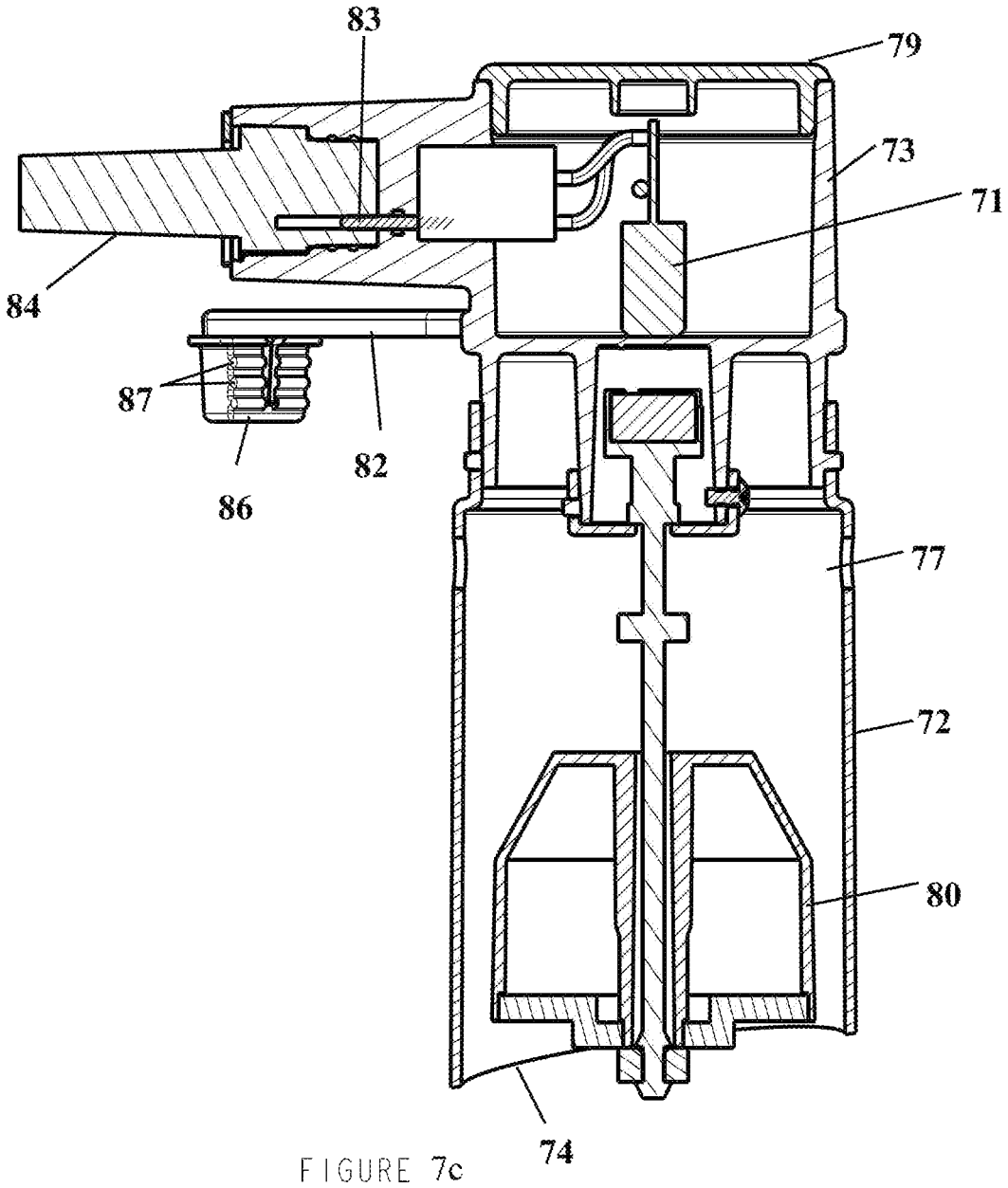
FIG. 7*c* is a side cutaway view of the float-switch sensing system of FIG. 7*a*.
Figure 7D:
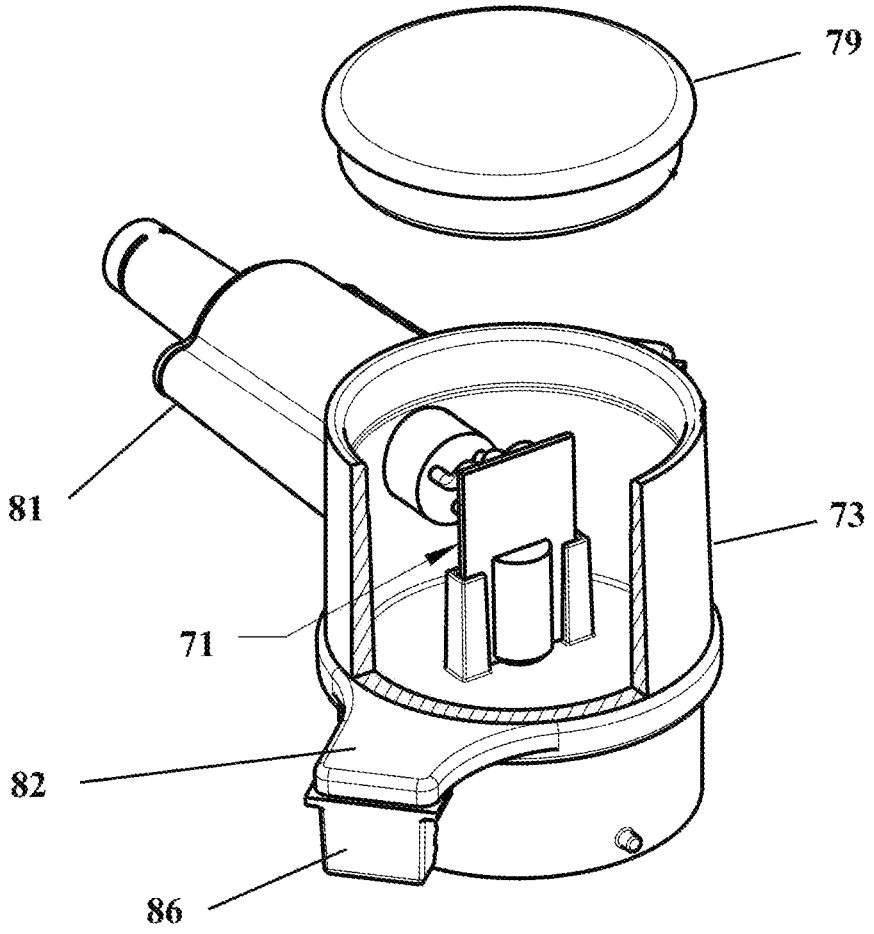
FIG. 7*d* is a perspective partial cutaway view of a switch housing of the float-switch sensing system of FIG. 7*a*.
Figure 7E:
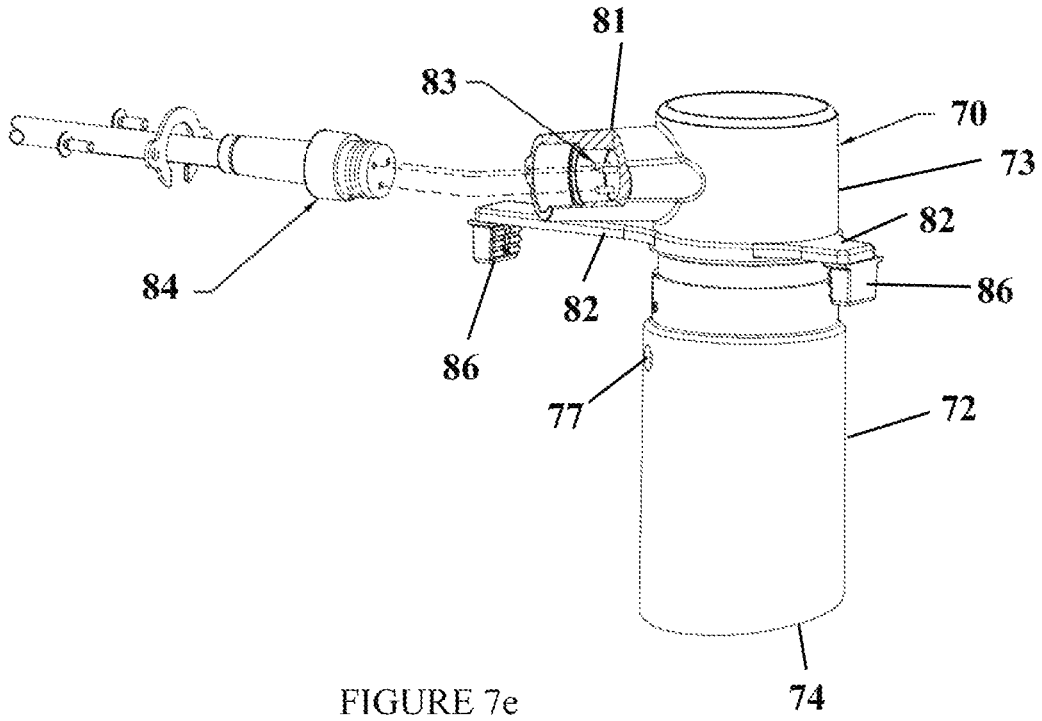
FIG. 7*e* is a side perspective view of the float-switch sensing system of FIG. 7*a* for attachment to a cord from a pump of the unit of FIG. 1.

As shown in FIGS. 7*b* and 7*c*, float housing 72 is secured to the switch housing 73. The float housing is tubular shaped and open at the bottom to permit fluids within the tank to enter and raise the float 80. In one embodiment, the lower edge 74 of the float housing is contoured and sloped to match the contour and slope of a portion of the surface of the floor provided opposite to the edge.

In one embodiment, as shown in FIG. 7*b*, an air relief hole 77 is provided in a side of the float housing to help prevent floatation of the float-switch system within the tank when fluids are present therein.

Figure 7F:
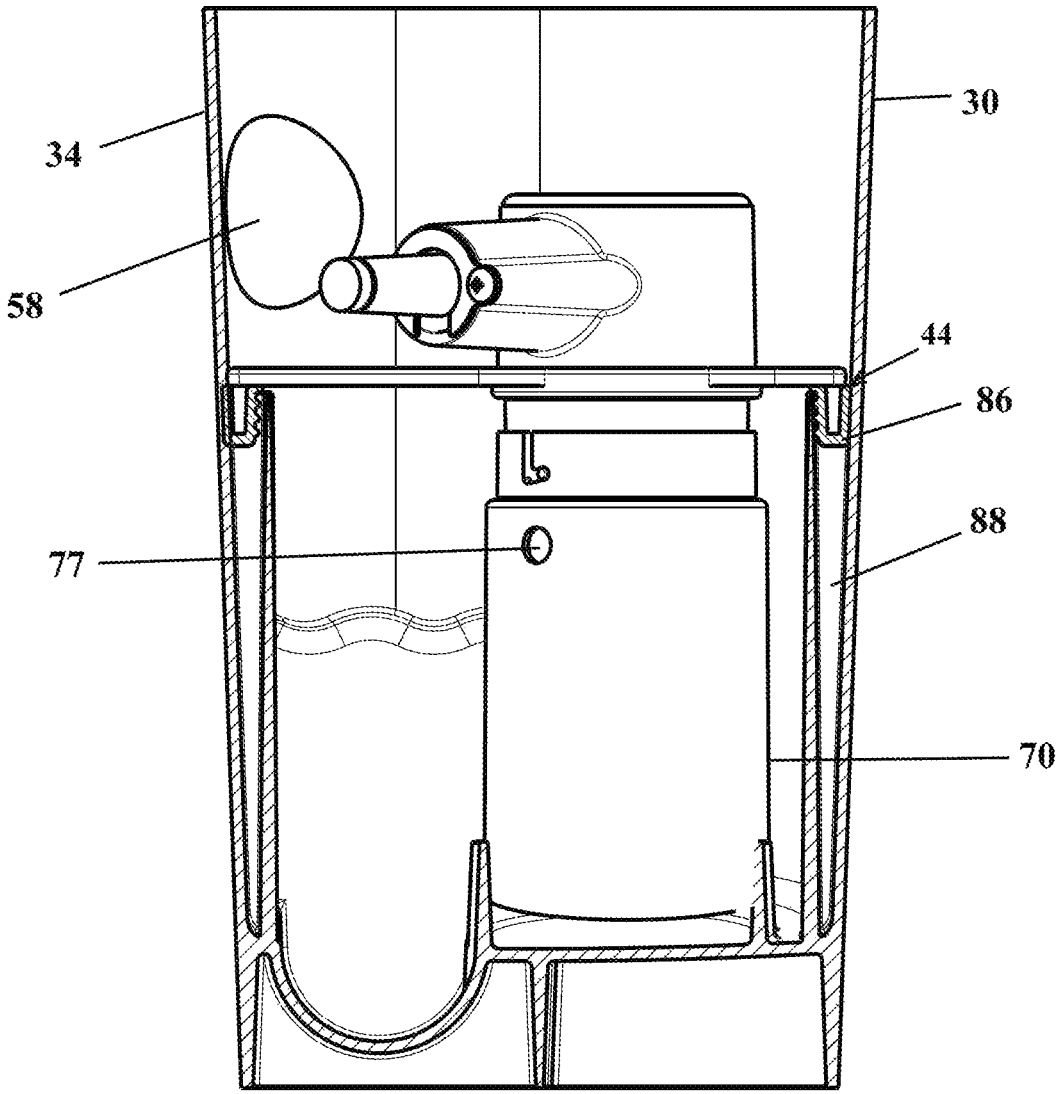
FIG. 7*f* is an end perspective cutaway view of the tank of FIG. 5*a* with the float-switch sensing system of FIG. 7*a* installed therein.

The modular float-switch sensing system 70 also includes arms 82 extending toward the front section 30 and back section 34 of the tank 20, as shown in FIGS. 7*e* and 7*f*. Attached to an end of each of the arms is a rubberized or elastic foot 86. See FIGS. 7*a* through 7*f*. In one embodiment these rubberized feet are similar in design, shape, and structure to the rubberized feet 148 which are used with the grinder pump 130 and discussed above. The rubberized feet are designed to fit into openings in molded ribs 88, which are secured to or molded into the inside surface 50 of the front section 30 and back section 34 of the tank, as shown in FIGS. 6*b* and 7*f*. When the float-switch sensing system is installed within the tank, each of the rubberized feet are pushed into in the molded ribs to hold the float-switch sensing system securely in place within the tank. This structure also provides stability to the tank.

To enhance the securing capability of the rubberized feet within the openings in the molded ribs, in one embodiment, the rubberized feet contain ridges 87. See FIG. 8. It is apparent to one of ordinary skill in the art that other designs of these rubberized feet may be used in a similar manner to secure the float-switch sensing system in place in the tank. For example, see the discussion of alternative structures for the rubberized feet 148 used with the grinder pump. This structure provides easy installation, as well as easy removal of the modular float-switch sensing system, for repair or replacement.

The choice and location of the float-switch sensing system 70 and the grinder pump 130 within the tank 20 provides an efficient design. Specifically, the float-switch sensing system and the grinder pump are located near opposite ends of the tank, as shown in FIGS. 3, 4*a* and 4*b*. By this design choice using modularized components, by the method of securing those components within the tank, and by the method of securing the lid 40 to the tank 20, the grinder pump and the float switch sensing system are easily accessible for servicing.

Figure 10A:
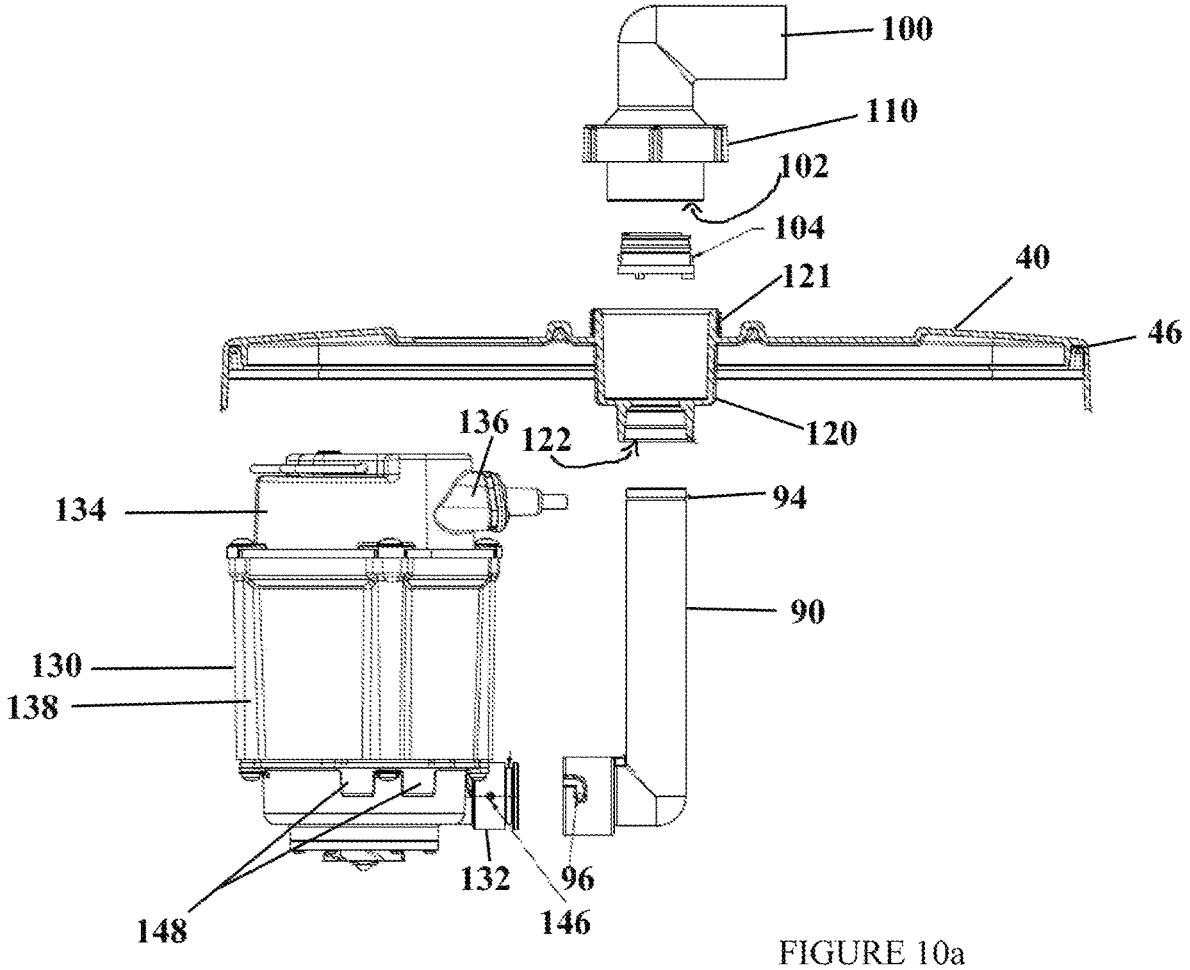
FIG. 10*a* is a partially exploded side cutaway view of a grinder pump and discharge elements from FIG. 1.
Figure 10B:
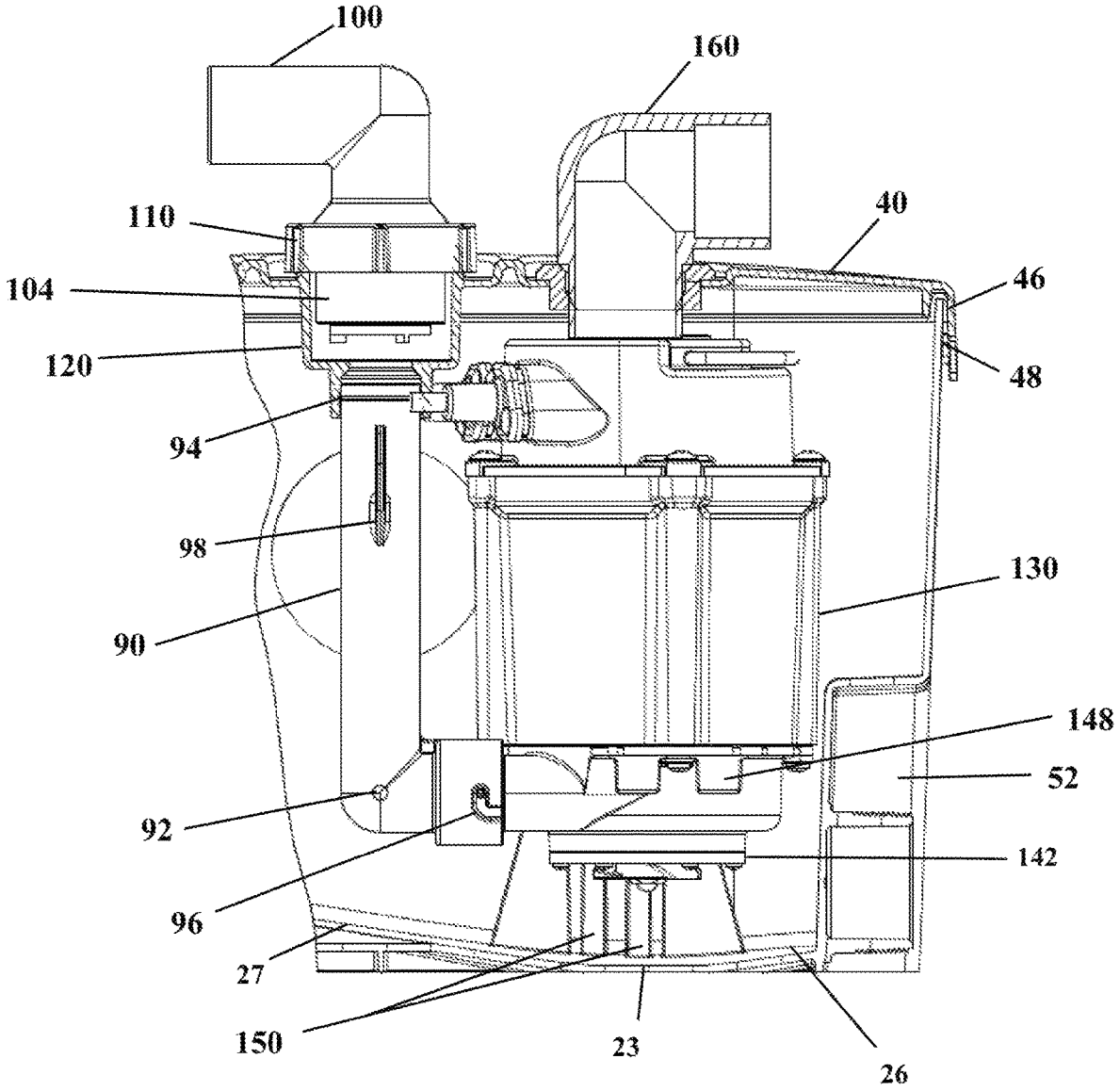
FIG. 10*b* is a cutaway end view of the unit of FIG. 1 showing the grinder pump and discharge elements of FIG. 10*a*.
Figure 10C:
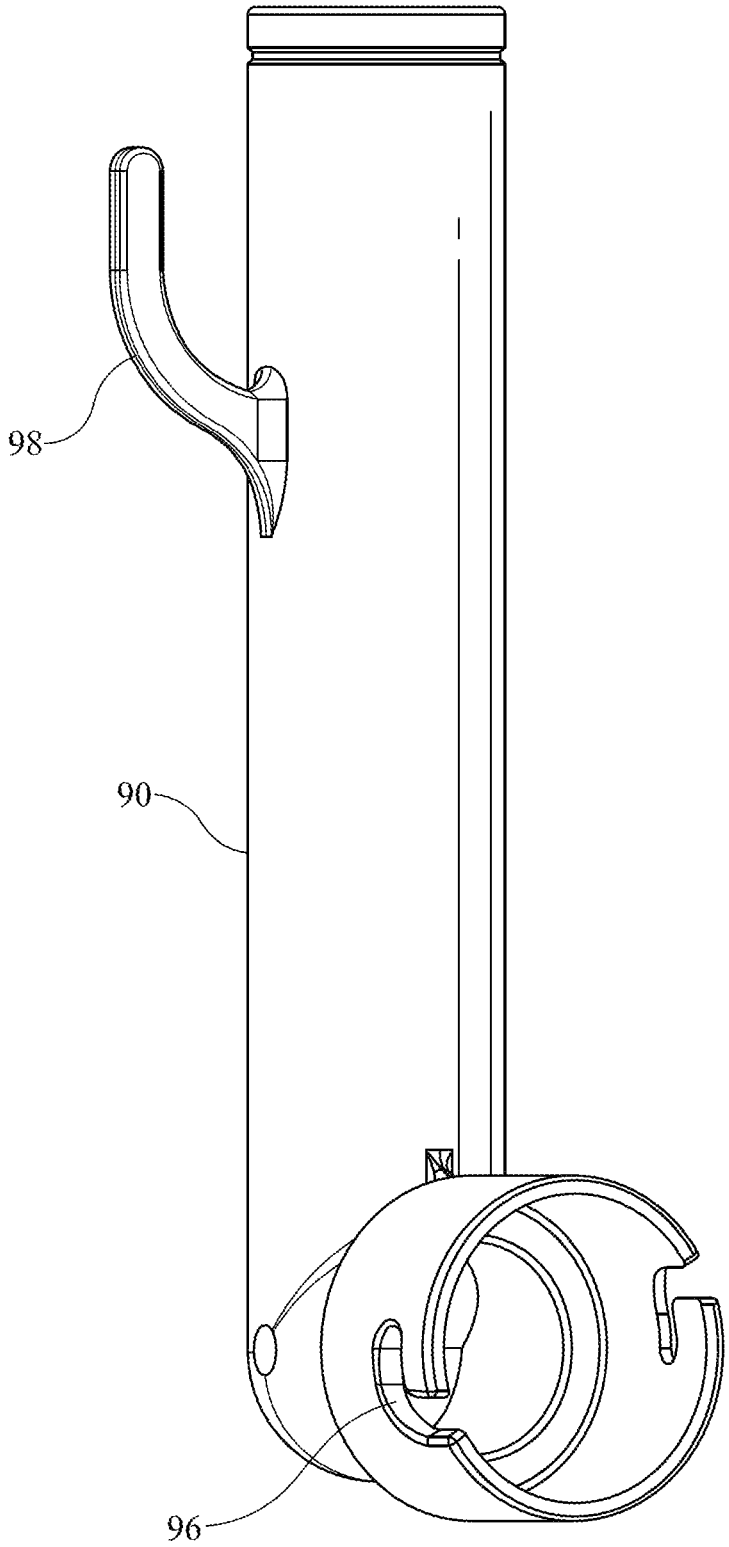
FIG. 10*c* is a side view of a discharge pipe of the discharge elements of FIG. 10*b*.

Another element of this waste collection and disposal unit 10 is a discharge system for discharging waste from the unit. The discharge system includes a discharge pipe 90, which is connected to the grinder pump 130, as shown in FIGS. 3, 4*a*, 4*b*, 10*a* and 10*b*. To secure the discharge pipe to the grinder pump, nubs 146 are provided on an outlet 132 of the grinder pump, as shown in FIGS. 9*a*, 10*a* and 10*b*. When the discharge pipe is secured to the grinder pump, these nubs extend through a slot 96, which is present in the inlet portion of the discharge pipe, as shown in FIGS. 10*b* and 10*c*. In one embodiment, an o-ring is utilized on the outlet of the grinder pump to assure a watertight seal.

In one embodiment, a discharge pipe hook 98 is secured to or molded into the discharge pipe 90, as shown in FIGS. 10*b* and 10*c*. This discharge pipe hook is useful to hold electric cords present within the tank and prevent them from falling downward into waste or wastewater in the tank.

In one embodiment, an air relief hole 92 is provided in the discharge pipe within the tank to avoid air locking, as shown in FIG. 10*b*. Further, a flow of discharge liquids from this hole operates in conjunction with the design of the floor of the tank to reduce the likelihood of accumulating sludge and other materials, to stir up waste present in the tank, and to lessen the production of unwanted odors within the tank. In particular, when air relief hole 92 is present, a stream of liquids is emitted from this hole 92 against a wall of the tank. This liquid stream creates flow within the tank and assists in moving waste and sludge towards the flat portion of the tank, which in turn acts to feed the effluent mixture of liquids and waste to the pump for treatment.

The discharge pipe 90 extends from the outlet 132 of the pump to a threaded adaptor 120 molded into the lid, as shown in FIGS. 3, 10*a* and 10*b*. The structure of the threaded adaptor 120 in the lid is designed for connection of discharge pipe 90 with the discharge elbow 100. The structure of the threaded adaptor permits unrestricted flow of waste from the unit while permitting quick and simplified access within the tank for repair.

Discharge pipe 90 in one embodiment is secured to the threaded adaptor by pressing the discharge pipe into a discharge pipe opening 122 in the threaded adaptor, as shown in FIG. 10*b*. To assure a tight fit, in one embodiment an o-ring 94 is utilized which fits within a slot on an inner surface of the discharge pipe opening 122, as shown in FIG. 10*a*. When the lid 40 of the tank is secured onto the tank, a tight watertight seal is provided between the threaded adaptor 120 and the discharge pipe 90.

Discharge elbow 100 is secured to a top portion of the threaded adaptor 120 of the tank lid 40, as shown in FIGS. 3, 4*a*, 4*b*, 10*a*, and 10*b*. The discharge elbow in one embodiment has a 90 degree turn as it exits the tank. The discharge elbow contains a lower lip 113 with lower opening 102, which lip is secured to, or extended within, the threaded adaptor 120 to receive waste from the discharge pipe. On the portion of the discharge pipe that is extended to or into the tank is flange 112, as shown in FIG. 3. This flange is secured to, or a component of, the formed discharge elbow. A lock nut 110 is placed over the discharge pipe and sets on top of the flange. The lock nut is threaded around a threaded lip 121 of the lid, with a discharge opening 41 therein, which lock nut extends upward from a top surface of the lid. An o-ring 114 is included as part of this joint to securely attach the lock nut to the molded threaded adaptor. See FIG. 3.

Figure 11A:
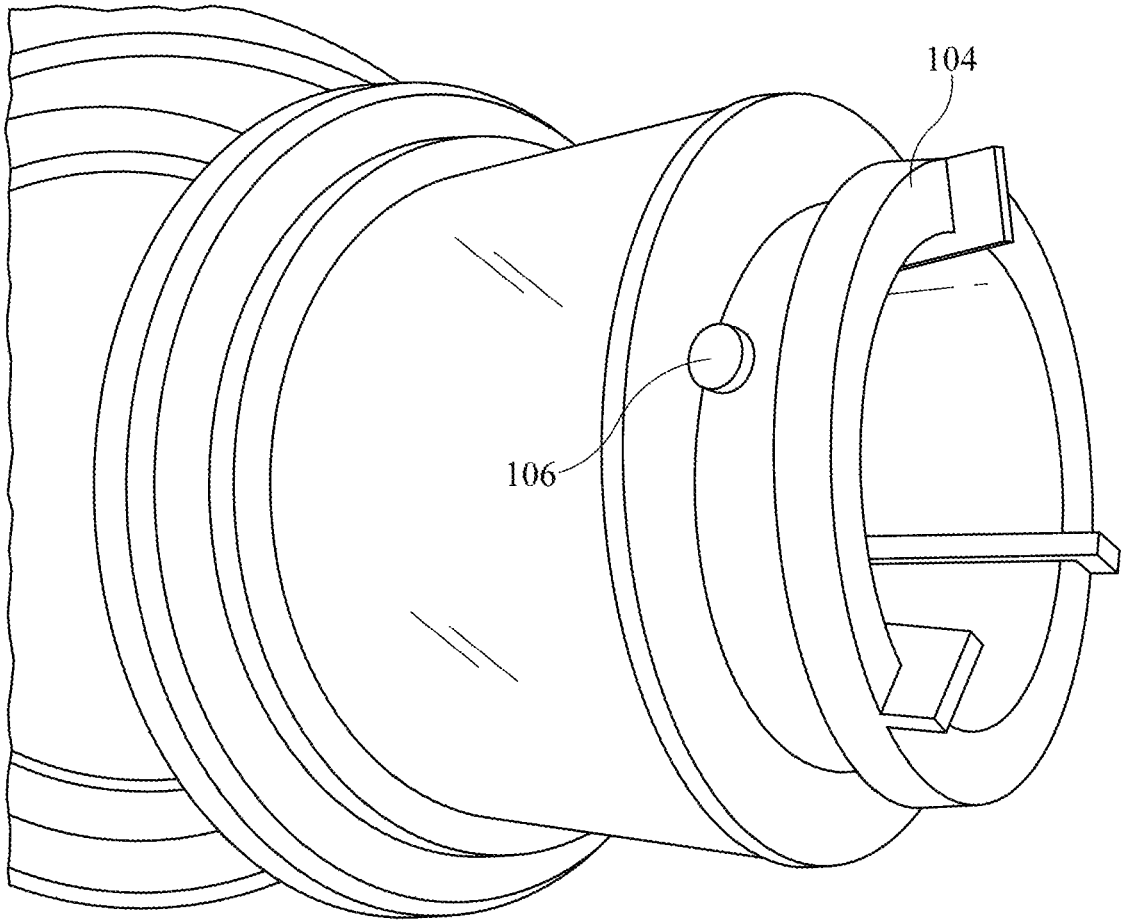
FIG. 11*a* is a perspective view of a check valve for installation in a discharge elbow of the unit of FIG. 1.
Figure 11B:
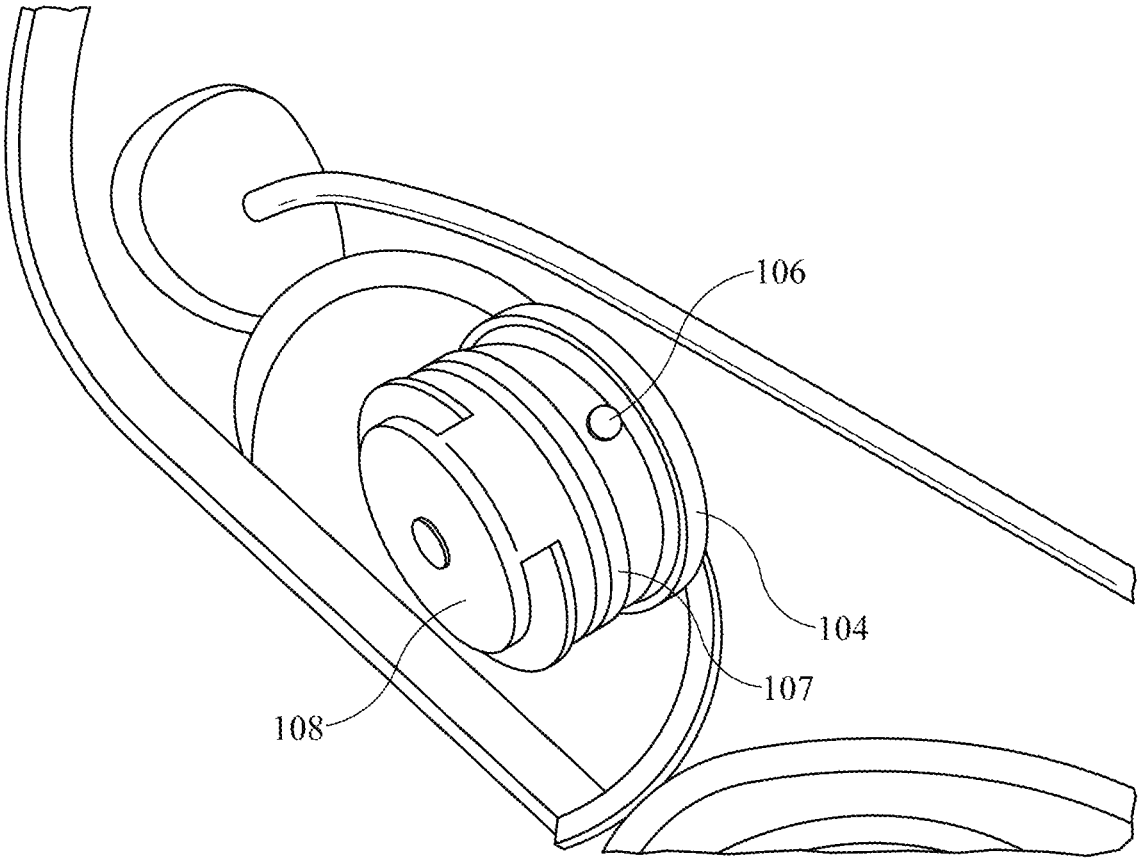
FIG. 11*b* is a perspective view of the check valve of FIG. 11*a*.
Figure 11C:
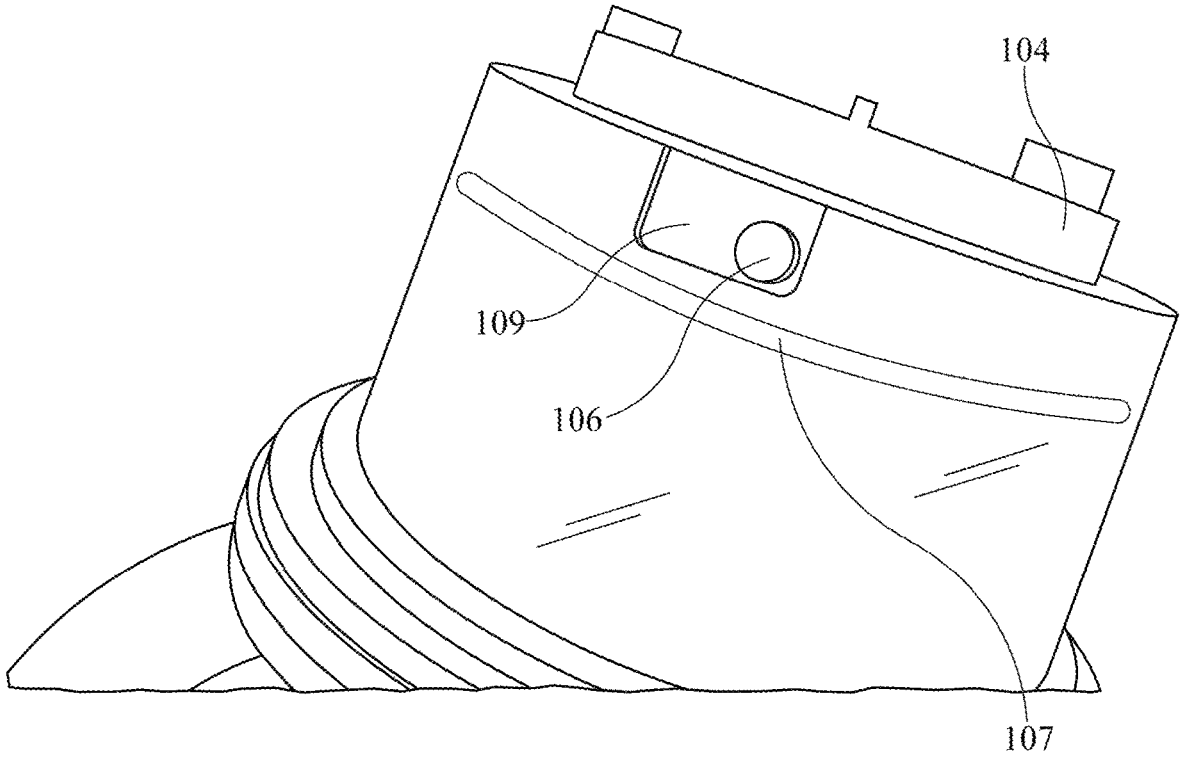
FIG. 11*c* is a side view of the check valve of FIG. 11*a*.

In one embodiment, a check valve 104 is secured within the discharge elbow 100. The check valve includes an o-ring 107 for securing it in place and a flapper 108 to assist. See FIG. 3. One embodiment for securing the check valve in the discharge elbow is shown in FIGS. 3, 11*a*, 11*b*, and 11*c*. The check valve is pressed into place in the discharge elbow and twisted and locked into place. The check valve is inserted into the lower opening 102 of the discharge elbow. The check valve has protruding horizontal nubs 106 that are introduced into channel 109 on an inside surface of the discharge elbow. These horizontal nubs are pushed vertically into the discharge elbow and twisted and locked into position. In one embodiment, the nubs are of different sizes to ensure that the valve is correctly installed. In one embodiment of the structure and arrangement of the check valve within the discharge pipe is shown in FIGS. 11*a* through 11*c*.

In one embodiment, as shown in FIG. 3, lock nut 110 is of a larger diameter than discharge elbow 100 so that that it fits over discharge elbow 100. Nut 110 is sized so that it can be loosened and traverse the neck 101 of discharge elbow. Check valve assembly 104 is formed such that it does not extend outside of an end face 103 of elbow. A face of assembly 104 is flush with the plane formed by end face 103, such that nut 110 is tightened onto threads 124 that are provided on threaded lip 121 formed in lid 40. The face of the assembly is approximately flush with a parallel plane running within the outer surface of lid. When combining the oversized nut 110 with a valve assembly 104, such a combination of elements is beneficial as it allows for a technician to easily remove or install the elbow 100, particularly in tight spaces were installing or removing the elbow is challenging due to other objects, such as the back portion of a toilet.

In one embodiment, a vent pipe 160 or carbon gas vent is also be included in the unit 10, as shown in FIG. 3. It is secured to and through the lid 40 of the tank through a filter opening 42 cut in the lid. In one embodiment, it is secured in place by a pipe seal 162.

Herein and within the claims, the terms "at least" and "approximately" are used. It will now be apparent to one of ordinary skill in the art that these terms are used consistent with their use in the arts. As such, when modified by "at least" or "approximately", it will now be apparent to one of ordinary skill in the art that the absolute value modified may vary within accepted engineering tolerances. Herein the terms "upward" and "downward" or "downwardly" are used. These terms are defined with respect to an axis running between the flat portion of the floor 23 and the lid 40. The upward direction is moving from the flat portion to the lid and the downward moving in the opposite direction.

From the forgoing description, it will now be apparent to one of ordinary skill in the art that various modifications are possible without deviating from the scope of the invention. It will further be apparent to one of ordinary skill in the art that various engineering design choices may be utilized within the scope of the invention. Where the specification references approximately equal, it will be clear to one of ordinary skill in the art that "approximately" or "approximately equal" results in a snug fit between two components. This means that, for example, a first diameter of an object encompassed by a second object having a second diameter will vary in diameter between the two objects by 0.01-1% of diameter. In other words, the smaller diameter object will have an outer diameter of 0.01-1% smaller than the larger diameter of the object receiving the smaller object. For further clarification, and particularly in the case of elastomeric or other compression seals, it will also now be apparent to one of ordinary skill in the art that one object's diameter will not be fixed and is a function of the pressure applied along the diameter. As such, in some cases the diameters of two objects may be "approximately equal" when under compression the diameter of the first object being inserted into a second object may be the same or greater than the second object by 0.01-10%, but under compression will "snug" up and form at least a partial seal when in place.

Similarly, one of ordinary skill in the art will now understand that the word "about" is used to describe industry accepted tolerances. For example, in describing the slope of the floor, in one embodiment, is at least about 5 degrees, and, in another embodiment is from about 8 to 12 degree, it will now be apparent to one of ordinary skill in the art that the absolute slope can vary by +/−1 degree as required to accommodate engineering and manufacturing requirements.

The foregoing detailed description is provided for understanding and does not provide any limitation on the scope of the claims. Modifications to the invention will be obvious to those skilled in the art upon a review of the disclosure without departing from the scope of the appended claims.

LIST OF ELEMENTS

10—Waste collection and disposal unit
20—Tank
21—Toilet
22—Floor
23—Flat portion of floor
24—Surface of floor
25—Sloped portion of floor
26—Sloped portion of floor
27—Sloped portion of floor
28—Support structure
30—Front section
34—Back section
38—Side sections
40—Lid
41—Discharge opening
42—Filter opening
43—Lips of lid
44—Lip seal
46—Downwardly facing slot
48—Clip opening
49—Clip edge
50—Inside surface of Tank
52—Inwardly indented portion of Tank side
54—Upper edge of Tank
56—Front inlet
57—Side inlets
58—Side opening for cord
59—Electrical cord
60—Seal
70—Float-switch sensing system
71—Switch circuit board
72—Float housing
73—Switch housing
74—Lower edge of float housing
77—Air relief hole
79—Cap of float housing
80—Float
81—Switch cord
82—Arms
83—Pin connection
84—Cord from pump
86—Rubberized foot
87—Lateral ridges
88—Ribs
90—Discharge pipe
92—Air relief hole
94—O-ring
96—Slot
98—Discharge pipe hook
100—Discharge Elbow
101—Neck

102—Lower Opening
103—End face
104—Check valve
106—Nubs
107—O-ring
108—Flapper
109—Channel
110—Lock nut
112—Flange
113—Lower lip
114—O-ring
120—Threaded adaptor
121—Threaded lip
122—Discharge pipe opening
124—Threads
130—Pump
132—Outlet
134—Upper cover
136—Cord seals
138—Pump housing
140—Cutter blade
142—Cutter plate
144—Lower cover
146—Nubs
148—Rubberized feet
150—Slots
160—Vent pipe
162—Pipe seal

We claim:

1. A waste collection and disposal unit comprising a tank, a float-switch sensing system, which senses the level of liquids within the tank, and a grinder pump, wherein the tank comprises a contoured and sloping floor, a front section, a back section, two side sections, and a lid;

wherein a surface of the floor slopes downward from below the float-switch sensing system to below the grinder pump, and wherein the surface of the floor is contoured in a downwardly curved shape extending between the front and back sections of the tank.

2. The unit of claim 1 wherein an opening is present in a back or side section of the tank, which opening is configured to receive a cord seal, the cord seal encompassing a portion of an electrical cord running through the cord seal, wherein the cord seal diameter and the opening diameter are approximately equal.

3. The unit of claim 1 wherein the lid is a one-piece lid attached to an upper edge of the side sections, the front section, and the back section of the tank, wherein the lid includes downwardly extending lips forming a downwardly extending slot.

4. The unit of claim 1 wherein attached to the grinder pump are rubberized feet, wherein slots are molded or formed on an inside surface of the tank, and wherein the rubberized feet are within the slots of the tank when the pump is installed within the tank.

5. A waste collection and disposal unit comprising a tank, a float-switch sensing system, which senses the level of liquids within the tank, and a grinder pump, wherein the tank comprises a contoured and sloping floor, a front section, a back section, two side sections, and a lid;

wherein the surface of the floor is contoured in a downwardly curved shape extending between the front and back sections of the tank;

wherein the float-switch sensing system comprises a switch housing and a float housing;

wherein the switch housing contains electronic components for operating a float switch;

wherein the switch housing is secured to the float housing;

wherein the float housing encloses a float; and wherein a lower edge of the float housing is contoured and sloped to match the contour and slope of a portion of the surface of the floor provided opposite to the edge.

6. The unit of claim 5 wherein the float-switch sensing system further comprises arms extending toward the front section and the back section of the tank when the system is installed into the tank.

7. The unit of claim 6 wherein secured to each end of the arms is a rubberized foot;

wherein an inside surface of the front and back sections of the tank includes a molded slot; and wherein the rubberized feet are within the slot when the float-switch sensing system is installed within the tank.

8. The unit of claim 7 wherein the rubberized feet include ridges or a tread-like structure on a surface thereof.

9. The unit of claim 5 wherein the grinder pump is a fractional horsepower, reversing grinder pump.

10. The unit of claim 5 wherein the grinder pump is electrically connected to electronic components of the switch housing by a pin connection contained in a switch cord.

11. The unit of claim 5 further comprising a vent pipe with carbon gas vent secured within an opening in the lid.

12. The unit of claim 5 wherein the lid is a one-piece lid secured to the side sections, the front section, and the back section of the tank, wherein the lid includes downwardly extending lips forming a downwardly extending slot.

13. The unit of claim 5 wherein attached to the grinder pump are rubberized feet, wherein slots are formed or molded into an inside surface of the tank, and wherein the rubberized feet of the grinder pump are within the slots of the tank when the pump is installed within the tank.

14. The unit of claim 5 further comprising a discharge system comprising a discharge pipe secured to the grinder pump, wherein an air relief hole is provided within the discharge pipe.

15. The unit of claim 14 further comprising a discharge pipe hook secured or molded into the discharge pipe.

16. A waste collection and disposal system comprising a tank, a modularized float-switch sensing system located within the tank, a grinder pump located within the tank, and a discharge system secured to an outlet of the grinder pump;

wherein the tank comprises a contoured and sloping floor, a front section, a back section, two side sections and a lid, wherein a surface of the floor slopes downward from below the float-switch sensing system to below the grinder pump;

wherein the surface of the floor is contoured in a downwardly curved arc extending between the front and back section of the tank; and wherein the lid is a one piece lid secured to the front, back and side sections of the tank by a clip which extends over a clip edge of a lip of the tank.

17. The unit of claim 16, wherein the float-switch sensing system further comprises arms extending toward the front section and the back section of the tank.

18. The unit of claim 17, wherein there are secured to each end of the arms a rubberized foot;

wherein an inside surface of the front and back sections of the tank includes a molded or formed slot; and wherein the rubberized feet are within the slots when the float-switch sensing system is installed within the tank.

19. The unit of claim 16, wherein attached to the grinder pump are rubberized feet;

wherein slots are formed or molded into an inside surface of the tank, wherein the rubberized feet of the grinder pump are within the slots of the tank when the grinder pump is installed within the tank.

20. The unit of claim 16, wherein the floor further comprising a flat portion with a diameter approximately equal to a diameter of a portion of the pump.

* * * * *